US007278386B2

(12) United States Patent
Hori et al.

(10) Patent No.: US 7,278,386 B2
(45) Date of Patent: Oct. 9, 2007

(54) VALVE TIMING CONTROLLER

(75) Inventors: Akira Hori, Handa (JP); Akihiko Takenaka, Anjo (JP); Shuji Mizutani, Nagoya (JP)

(73) Assignee: DENSO CORPORATION (JP)

( * ) Notice: Subject to any disclaimer, the term of this patent is extended or adjusted under 35 U.S.C. 154(b) by 0 days.

(21) Appl. No.: 11/482,704

(22) Filed: Jul. 10, 2006

(65) Prior Publication Data

US 2007/0012270 A1 Jan. 18, 2007

(30) Foreign Application Priority Data

Jul. 12, 2005 (JP) ..... 2005-203454

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 6,848,401 B2 * 2/2005 Takenaka et al. ..... 123/90.15
6,920,855 B2 7/2005 Takenaka et al.
2004/0084000 A1 * 5/2004 Takenaka et al. ..... 123/90.17

* cited by examiner

*Primary Examiner*—Zelalem Eshete
(74) *Attorney, Agent, or Firm*—Nixon & Vanderhye PC

(57) ABSTRACT

A valve timing adjusting device includes: a first rotary body which rotates in synchronization with one of a crankshaft and a camshaft and into which lubricating fluid is supplied; a second rotary body which rotates in synchronization with the other; a torque producing unit for producing control torque; and a phase change unit including a planetary gear mechanism in which a planetary gear is engaged with a sun gear in such a way as to be able to perform a planetary motion. The phase change unit changes a relative rotational phase between the first rotary body and the second rotary body by utilizing the control torque transmitted from the torque producing unit to the planetary gear mechanism and has a space at an interface where the first rotary body is brought into sliding contact with the planetary gear.

26 Claims, 24 Drawing Sheets

VALVE TIMING CONTROLLER

CROSS-REFERENCE TO RELATED APPLICATION

This application is based on Japanese Patent Application No. 2005-203454 filed on Jul. 12, 2005, the disclosure of which is incorporated herein by reference.

FIELD OF THE INVENTION

The present invention relates to a valve timing controller for an internal combustion engine. The valve timing controller adjusts an opening/closing time (hereinafter referred to as "valve timing") of at least one of an intake valve and an exhaust valve that a camshaft opens or closes by torque transmitted thereto from a crankshaft.

BACKGROUND OF THE INVENTION

A valve timing controller changes the relative rotational phase between a first rotary body rotating in synchronization with a crankshaft and a second rotary body rotating in synchronization with a camshaft to adjust valve timing. For example, JP-2005-98142A (U.S. Pat. No. 6,920,855B2) discloses a valve timing controller that increases and utilizes control torque generated by an electric motor so as to change a relative rotational phase between two rotary bodies. In this valve timing controller, by utilizing large control torque outputted from a planetary gear mechanism, a response to a change in a relative rotational phase and an adjustment response of the valve timing can be enhanced.

In the valve timing controller disclosed in JP-2005-98142A, a planetary gear mechanism is accommodated in the rotary body rotating in synchronization with the crankshaft. A planetary gear constructing the planetary gear mechanism is brought into close contact with the rotary body rotating in synchronization with the crankshaft and a transmission rotary body constructing the planetary gear mechanism. This restricts a shift of the planetary gear and the transmission rotary body in an axial direction, and restricts the malfunction of the planetary gear mechanism.

However, when the planetary gear of the planetary gear mechanism is brought into close contact with the rotary body moving in synchronization with the crankshaft or the transmission rotary body of the planetary gear mechanism, wear is caused by the relative sliding between elements brought into close contact with each other. To reduce this wear, supplying lubricating fluid into the rotary body moving in synchronization with the crankshaft can be considered. However, the lubricating fluid is increased in viscosity at the time of low temperature and hence the lubricating fluid flowing between the elements and having high viscosity produces a large sliding resistance. The large sliding resistance produced in this manner might cause the malfunction of the planetary gear mechanism, which is not desirable.

SUMMARY OF THE INVENTION

The present invention has been made in view of the above-mentioned problem. The object of the present invention is to provide a valve timing controller capable of preventing malfunction.

In the present invention, a phase change unit changes a relative rotational phase between a first rotary body rotating in synchronization with one of a crankshaft and a camshaft and a second rotary body rotating in synchronization with the other of the crankshaft and the camshaft. At this time, the phase change unit changes the relative rotational phase by utilizing control torque transmitted from the torque producing unit to the planetary gear mechanism. Hence, the phase change unit can precisely adjust a valve timing according to the control torque.

A space is formed in the first rotary body at an interface where the first rotary body is brought into sliding contact with the planetary gear of the planetary gear mechanism, so that the contact area of the first rotary body and the planetary gear is decreased by the space. With this, even if lubricating fluid supplied into the first rotary body flows into an interface between the first rotary body and the planetary gear with its viscosity increased at the time of low temperature or the like, it is possible to restrict a increment in the sliding resistance between the first rotary body and the planetary gear.

DETAILED DESCRIPTION OF THE PREFERRED EMBODIMENTS

Hereinafter, a plurality of embodiments of the present invention will be described with reference to the drawings.

First Embodiment

Figure 2:
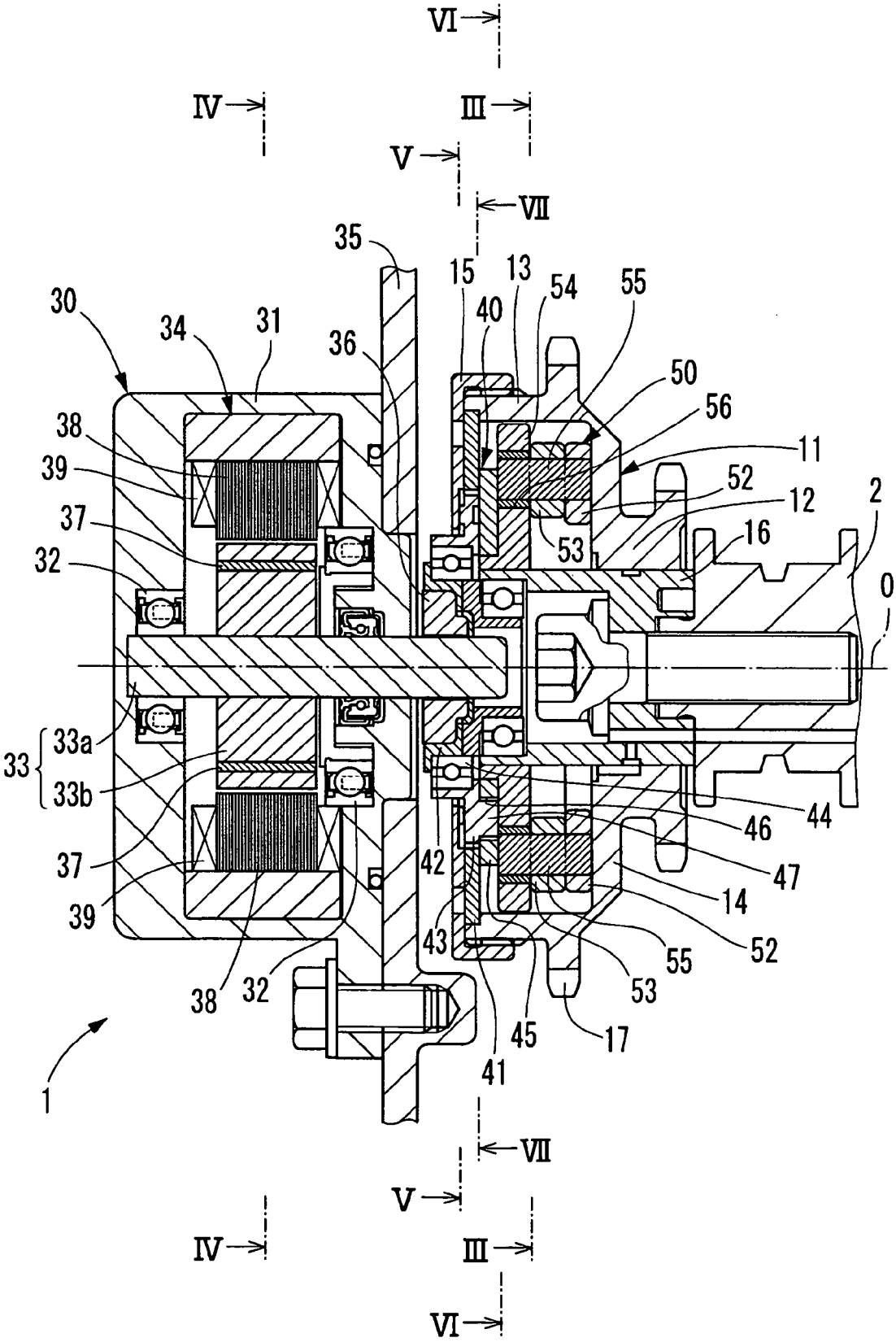
FIG. 2 is a cross-sectional view showing the valve timing controller according to the first embodiment and is a cross-sectional view taken on a line II-II in FIG. 3.

FIG. 2 shows a valve timing controller 1 according to a first embodiment of the present invention. The valve timing controller 1 is mounted in the transmission system of transmitting engine torque from a crankshaft of an internal combustion engine to a camshaft 2. The valve timing controller 1 adjusts the valve timing of an intake valve and/or an exhaust valve of the internal combustion engine by changing the relative rotational phase between the crankshaft and the camshaft 2.

The valve timing controller 1 includes a sprocket 11, an output shaft 16, an electric motor 30, a planetary gear mechanism 40, and a link mechanism 50.

As shown in FIG. 2, the sprocket 11 has a hollow shape as a whole and accommodates the planetary gear mechanism 40 and the link mechanism 50. This sprocket 11 includes a cylindrical shaft portion 12, a cylindrical input portion 13 having a diameter larger than the diameter of the shaft portion 12, a connection portion 14 for connecting the shaft portion 12 and the input portion 13 in a stepwise manner, and a cover part 15 fixed to a side opposite to the connection portion 14 of the input portion 13. The shaft portion 12 is coaxially fitted on the outer peripheral side of the output shaft 16. The input portion 13 has a plurality of teeth 17 formed thereon and a ring-shaped chain belt is looped around these teeth 17 and a plurality of teeth of the crankshaft. When engine torque outputted from the crankshaft is inputted to the input portion 13 through the chain belt, the sprocket 11 rotates around a rotational axis "O" in a clockwise direction in FIG. 3 while keeping a relative rotational phase between the sprocket 11 and the crankshaft. The connection portion 14 is formed in the shape of a plate vertical to the rotational axis "O". The cover part 15 is formed in the shape of a cylinder closed at one end and is fitted and fixed on the input portion 13 by a peripheral wall in such a manner that a bottom wall is perpendicular to the rotational axis "O".

Figure 3:
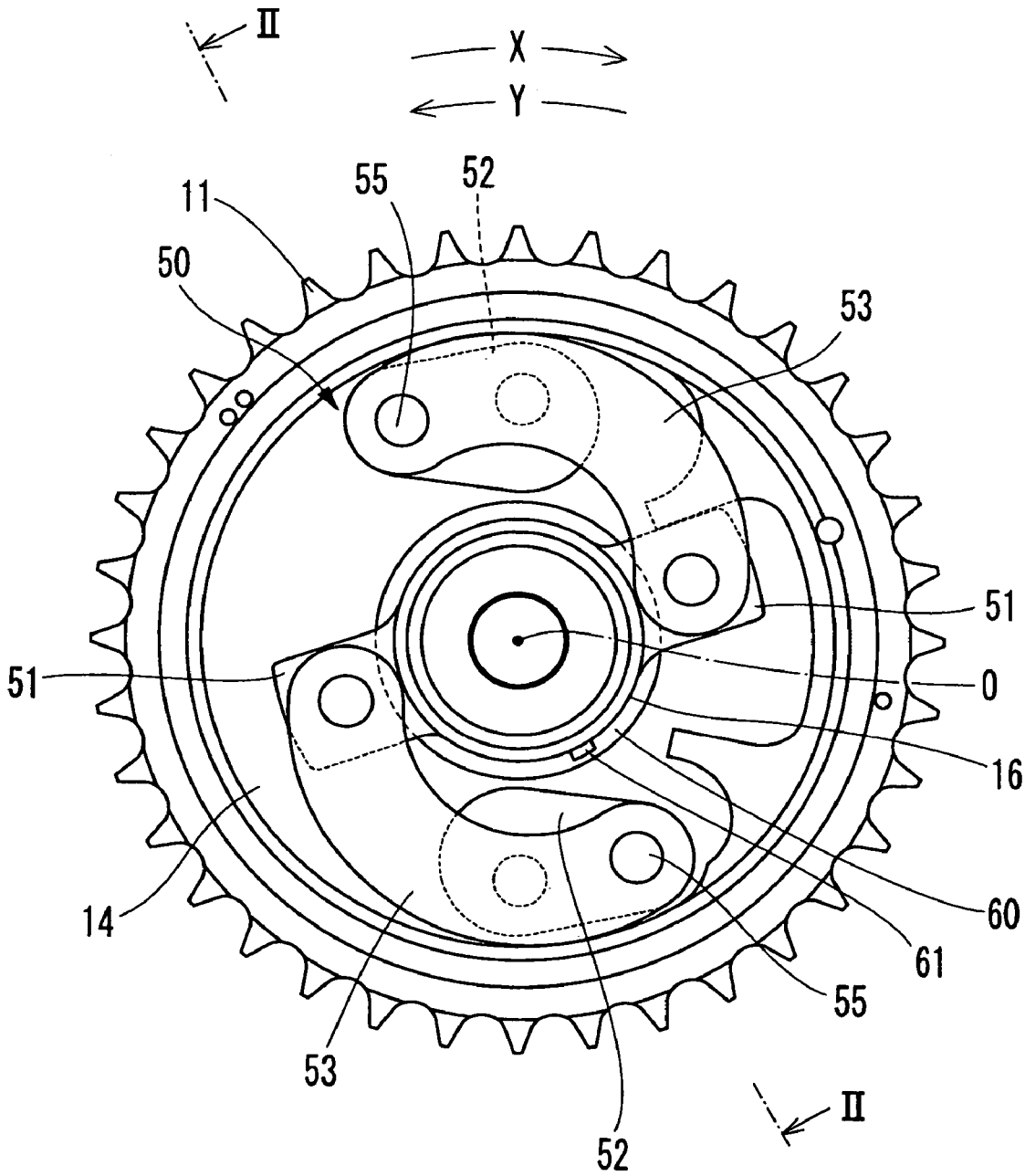
FIG. 3 is a cross-sectional view showing the valve timing controller according to the first embodiment and is a cross-sectional view taken on a line III-III in FIG. 2.

As shown in FIG. 2, the output shaft 16 is coaxially fixed to the camshaft 2. With this, the output shaft 16 can rotate around the rotational axis "O" while keeping a relative rotational phase with respect to the camshaft 2 and can rotate relatively to the sprocket 11. Here, in the following description, as shown in FIG. 3, a relative rotational direction in which the output shaft 16 advances with respect to the sprocket 11 is referred to as an advance direction X and a relative rotational direction in which the output shaft 16 retards with respect to the sprocket 11 is referred to as a retard direction Y. In the above description, the sprocket 11 corresponds to a first rotary body rotating in synchronization with the crankshaft. The output shaft 16 corresponds to a second rotary body rotating in synchronization with the camshaft 2.

Figure 4:
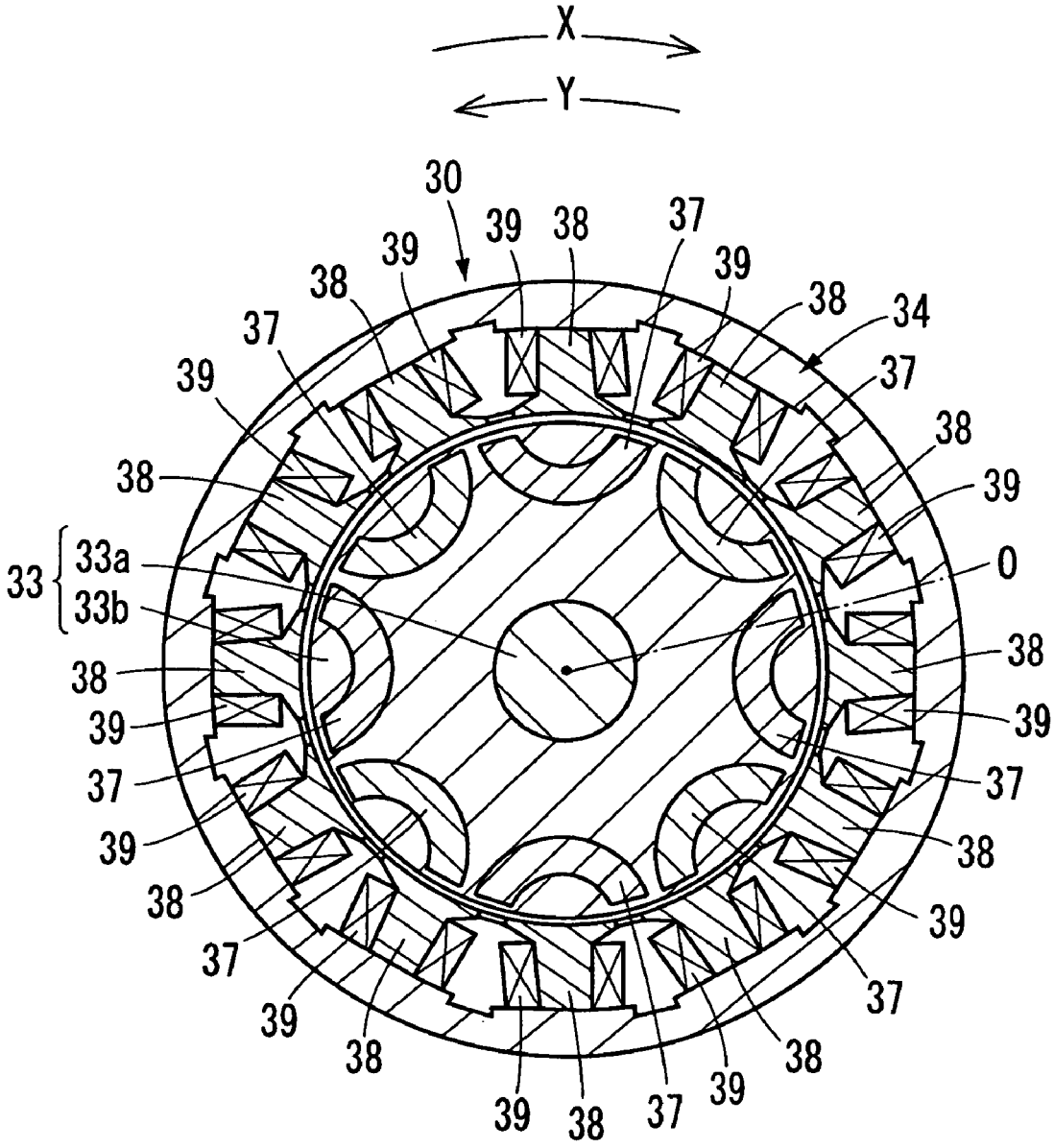
FIG. 4 is a cross-sectional view taken on a line IV-IV in FIG. 2 according to the first embodiment.

As shown in FIG. 2 and FIG. 4, the electric motor 30 includes a housing 31, bearings 32, a motor shaft 33, a stator 34, and the like.

The housing 31 is fixed to the internal combustion engine via a stay 35. Two bearings 32 and the stator 34 are accommodated in and fixed to the housing 31. The motor shaft 33 is arranged coaxially with the sprocket 11 and the output shaft 16 and is supported by the respective bearings 32 at two positions in an axial direction. The motor shaft 33 is coupled and fixed to an input shaft 42 of the planetary gear mechanism 40 via a shaft coupling 36 and can rotate around the rotational axis "O" along with the input shaft 42. The motor shaft 33 has a plate-shaped rotor part 33*b* protruding from its shaft body 33*a* to the outside in a radial direction. This rotor part 33*b* has a plurality of permanent magnets 37 buried therein at equal intervals around the rotational axis "O".

The stator 34 is arranged coaxially on the outer peripheral side of the motor shaft 33 and has a plurality of cores 38 and a plurality of coils 39. Each of the cores 38 is formed of a plurality of laminated iron plates and the plurality of cores 38 are arranged at equal intervals around the rotational axis "O". The coil 39 connected to a control circuit (not shown) is wound around each core 38. In this regard, the control circuit controls current passed through these coils 39 so as to form a rotary magnetic field applied to the respective permanent magnets 37 by exciting the respective coils 39 in a specified order. Hence, when current is passed through the coils 39 by the control circuit, control torques in the directions of X and Y according to the direction of the rotary magnetic field are applied to the motor shaft 33.

In the above description, the electric motor 30 corresponds to a torque producing unit for producing control torque.

Figure 5:
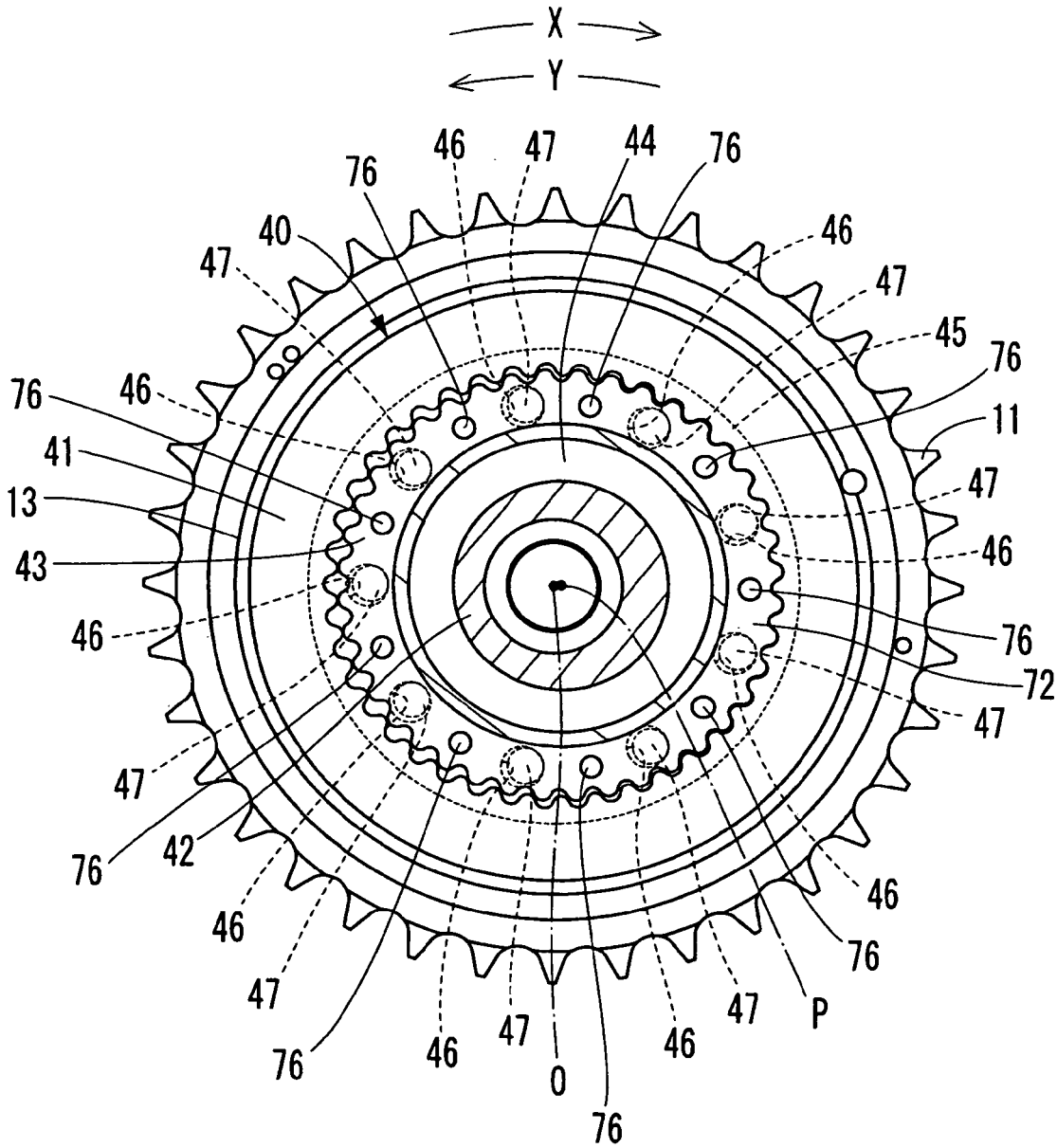
FIG. 5 is a cross-sectional view taken on a line V-V in FIG. 2 according to the first embodiment.

As shown in FIG. 2 and FIG. 5, the planetary gear mechanism 40 is comprised of a sun gear 41, an input shaft 42, a planetary gear 43, a bearing 44, and a transmission rotary body 45.

The sun gear 41 is an internal gear in which a tooth tip curved surface is arranged on the inner peripheral side of a tooth root curved surface and is coaxially fixed to the inner peripheral wall of the input portion 13. With this, the sun gear 41 can rotate around the rotational axis "O" along with the sprocket 11. The outer peripheral wall of the input shaft 42 coupled and fixed to the motor shaft 33 of the electric motor 30 is eccentric with respect to the rotational axis "O".

The planetary gear 43 is an external gear in which a tooth tip curved surface is arranged on the outer peripheral side of a tooth root curved surface and is adjacent to the cover part 15 of the sprocket 11 in the axial direction. The radius of curvature of the tooth tip curved surface of the planetary gear 43 is smaller than the radius of curvature of the tooth root curved surface of the sun gear 41 and the number of teeth of the planetary gear 43 is smaller than the number of teeth of the sun gear 41 by one tooth. With this, the planetary gear 43 is engaged with the inner peripheral side of the sun gear 41 so as to be able to perform a planetary motion. The input shaft 42 is fitted in the central hole of the planetary gear 43, whose rotational axis "P" is eccentric with respect to the rotational axis "O", via the bearing 44. With this, the input shaft 42 and the motor shaft 33 can rotate relatively to the sprocket 11.

The transmission rotary body 45 is formed in the shape of a flat plate perpendicular to the rotational axis "O" and is adjacent to a side opposite to the cover part 15 of the planetary gear 43 in the axial direction. Cylindrical engaging holes 46 are formed at a plurality of portions of the transmission rotary body 45. The respective engaging holes 46 are formed at equal intervals around the rotational axis "O" of the transmission rotary body 45 and are passed through the transmission rotary body 45 in the axial direction. In the planetary gear 43, cylindrical column-shaped engaging protrusions 47 are formed at a plurality of portions opposite to the engaging holes 46. The respective engaging protrusions 47 are formed at equal intervals around the rotational axis "P" of the planetary gear 43 and are protruded into the engaging holes 46 opposite to them. The transmission rotary body 45 is fixed to a guide rotary body 54 to be described later, thereby being able to rotate around the rotational axis "O" and to rotate relatively to the sprocket 11.

In the planetary gear mechanism 40 like this, when the motor shaft 33 does not rotate relatively to the sprocket 11, with the rotation of the sprocket 11, the planetary gear 43 rotates along with the sprocket 11 and the input shaft 42 while keeping a position where the planetary gear 43 is engaged with the sun gear 41. Then, the engaging protrusions 47 press the engaging holes 46 in the rotational direction and hence the transmission rotary body 45 rotates around the rotational axis "O" in the clockwise direction in FIG. 5 while keeping a relative rotational phase with respect to the sprocket 11. In contrast, when the motor shaft 33 rotates relatively to the sprocket 11 in the retard direction Y by an increase in control torque or the like, the planetary gear 43 rotates relatively to the input shaft 42 in the clockwise direction in FIG. 5 by the planetary motion. Then, the forces by which the engaging protrusions 47 press the engaging holes 46 in the rotational direction increase and hence the transmission rotary body 45 rotates relatively to the sprocket 11 in the advance direction X. Moreover, in contrast to this, when the motor shaft 33 rotates relatively to the sprocket 11 in the advance direction X by an increase in the control torque or the like, the planetary gear 43 rotates relatively to the input shaft 42 in a counterclockwise direction in FIG. 5 by the planetary motion. Then, the engaging protrusions 47 press the engaging holes 46 in a direction opposite to the rotational direction and hence the transmission rotary body 45 rotates relatively to the sprocket 11 in the retard direction Y.

Figure 6:
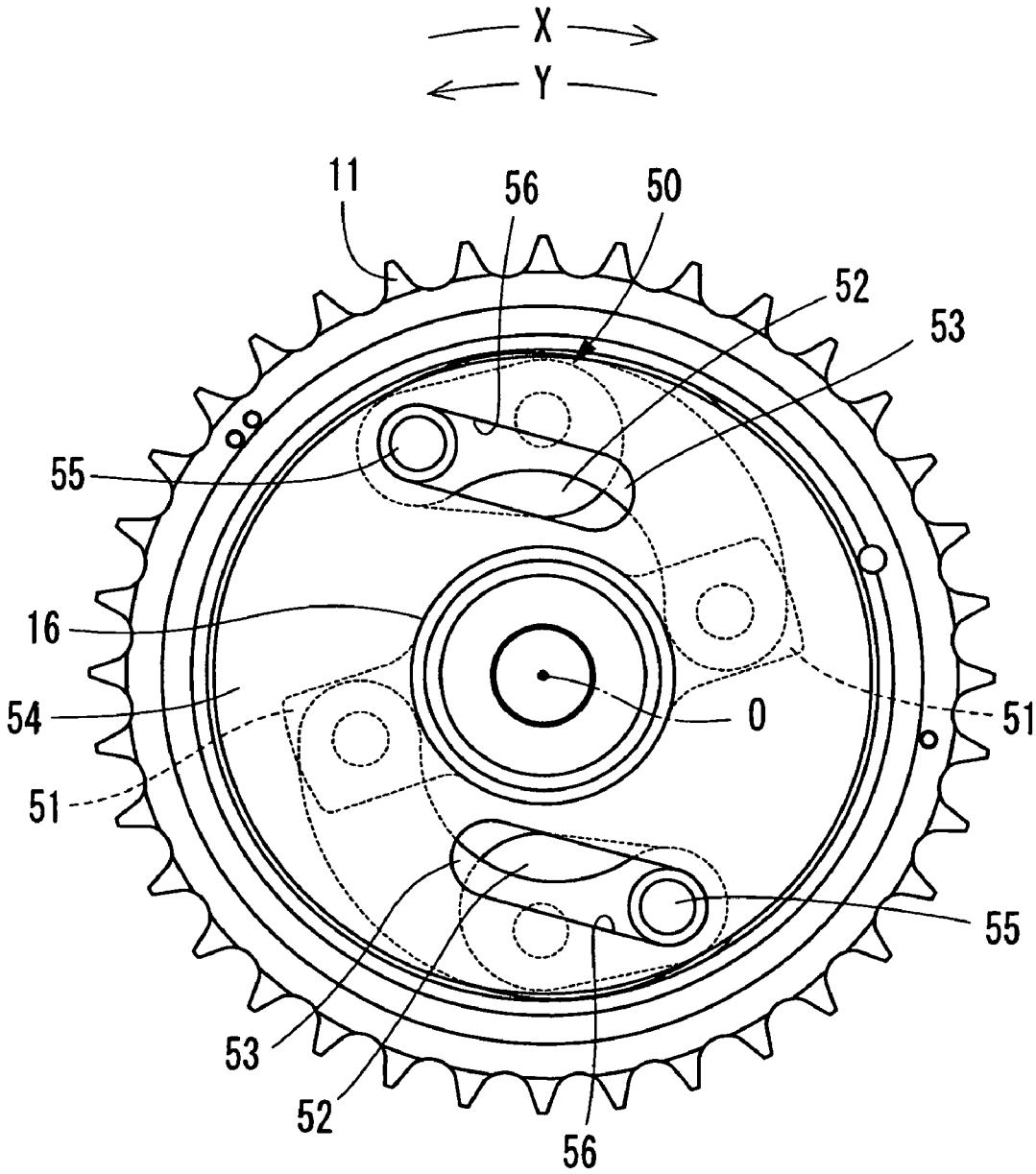
FIG. 6 is a cross-sectional view taken on a line VI-VI in FIG. 2 according to the first embodiment.

As shown in FIGS. 2, 3, and 6, the link mechanism 50 is constructed of a plurality of links 51 to 53, the guide rotary body 54, a plurality of movable bodies 55, and the like. Here, hatching showing a cross section is omitted in FIGS. 3 and 6.

The first links 51 are arranged in such a manner as to protrude from two positions sandwiching the rotational axis "O" of the output shaft 16 in directions opposite to each other. Each of the first links 51 is formed in the shape of a flat plate perpendicular to the rotational axis "O". The second links 52 are arranged at two positions sandwiching the rotational axis "O" in the connection portion 14 of the sprocket 11 in such a manner as to be coupled to each other by a turning pair. Each of the second links 52 is formed in the shape of a flat plate perpendicular to the rotational axis "O". The third links 53 are arranged in such a manner as to be coupled to one corresponding link of the first links 51 and one corresponding link of the second links 52, respectively, by a turning pair. Each of the third links 53 is formed in the shape of a flat plate perpendicular to the rotational axis "O". As described above, in the axial direction of the sprocket 11, the connection portion 14 is adjacent to the first and second links 51, 52 and the first and second links 51, 52 are adjacent to the third link 53.

The guide rotary body 54 is formed in the shape of a flat plate perpendicular to the rotational axis "O" and is coaxially fitted to the outer peripheral side of the output shaft 16. The guide rotary body 54 is fitted on and fixed to a side opposite to the planetary gear 43 of the transmission rotary body 45 in such a manner as to be sandwiched between the third links 53 and the transmission rotary body 45 in the axial direction. Hence, the guide rotary body 54 can rotate around the rotational axis "O" along with the transmission rotary body 45 and can rotate relatively to the sprocket 11 along with the transmission rotary body 45. Guide passages 56 passing through the guide rotary body 54 in the axial direction are formed at two positions sandwiching the rotational axis "O" of the guide rotary body 54. Each of the guide passages 56 is formed in the shape that is rotationally symmetric by 180° with respect to the rotational axis "O", that is, more specifically, in the shape of a long hole that extends straight on a slant with respect to a radial direction of the guide rotary body 54 and changes in distance in the radial direction from the rotational axis "O" in the direction of extension.

Each of the plurality of movable bodies 55 is shaped like a circular column and is sandwiched between the connection portion 14 of the sprocket 11 and the transmission rotary body 45. One end portion in the axial direction of each of the respective movable bodies 55 is fitted in the guide passages 56 corresponding thereto, thereby being coupled respectively to the guide rotary body 54 by a sliding turning pair. Moreover, other end portions in the axial direction of the respective movable bodies 55 are coupled respectively to the second and third links 52, 53 corresponding thereto by a turning pair.

In the link mechanism 50 like this, when the transmission rotary body 45 does not rotate relatively to the sprocket 11, the movable bodies 55 rotate along with the guide rotary body 54 without sliding relatively to the guide passages 56. At this time, the relative positional relationship between the turning pair formed by the second and third links 52, 53 and the rotational axis "O" does not change, so that the first link 51 and the output shaft 16 do not rotate relatively to the sprocket 11. In contrast, when the transmission rotary body 45 rotates relatively to the sprocket 11 in the advance direction X, the movable bodies 55 slides relatively to the guide passage 56 in a direction apart from the rotational axis "O". At this time, the turning pair formed by the second link 52 and the third link 53 are shifted in a direction apart from the rotational axis "O" along with the movable bodies 55, whereby the first link 51 and the output shaft 16 rotate relatively to the sprocket 11 in the retard direction Y. Moreover, in contrast to this, when the transmission rotary body 45 rotates relatively to the sprocket 11 in the retard direction Y, the movable bodies 55 slides relatively to the guide passage 56 in a direction coming near to the rotational axis "O". At this time, the turning pair formed by the second link 52 and the third link 53 are shifted in a direction coming near to the rotational axis "O" along with the movable bodies 55, whereby the first link 51 and the output shaft 16 rotate relatively to the sprocket 11 in the advance direction X.

In the above description, the planetary gear mechanism 40 and the link mechanism 50 construct a phase change unit in combination.

Next, the parts characteristic of the sprocket 11 and the output shaft 16 according to the first embodiment will be described.

Figure 1:
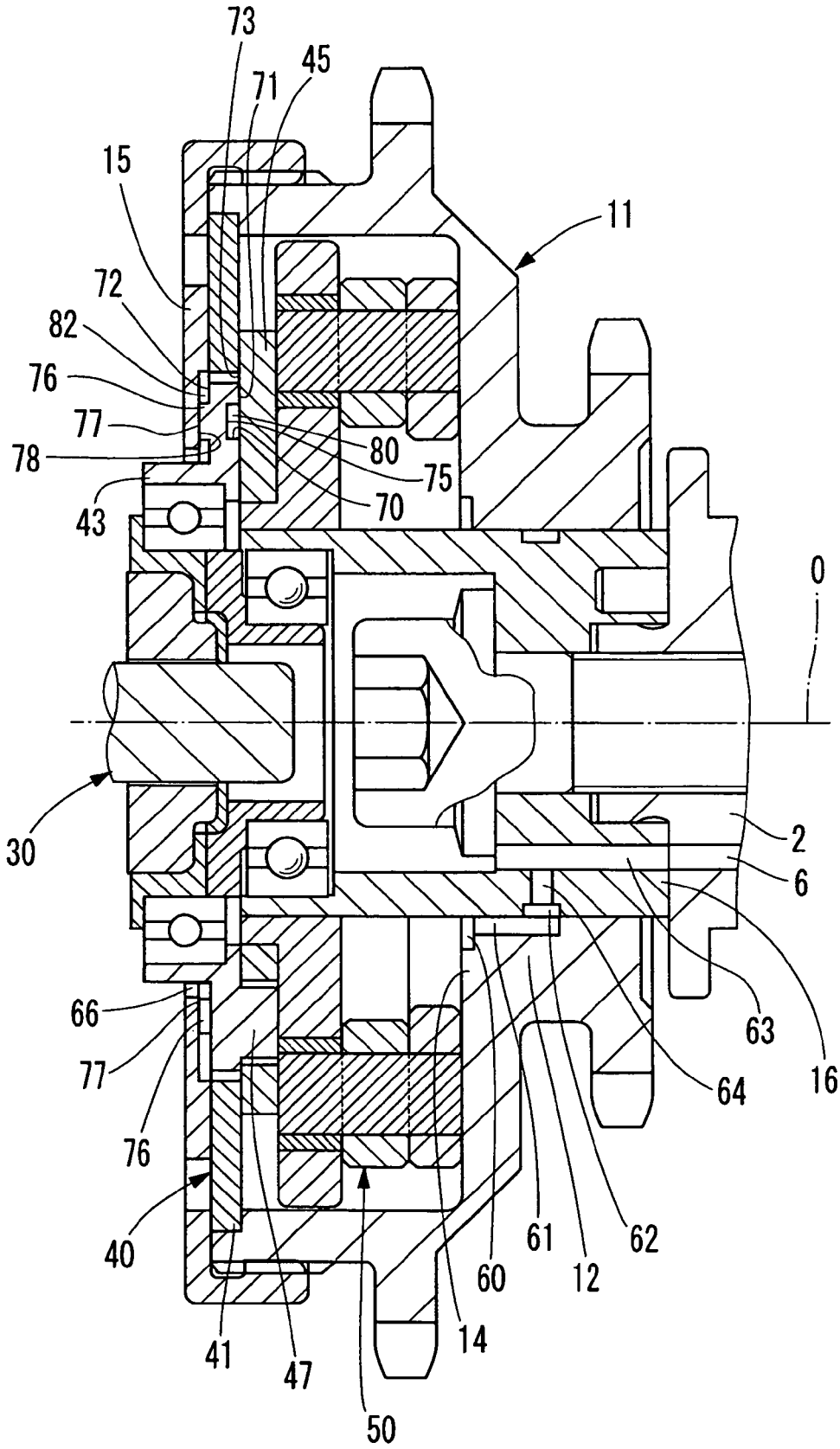
FIG. 1 is a cross-sectional view showing a valve timing controller according to a first embodiment and is an enlarged view of a main portion in FIG. 2.

As shown in FIGS. 1 and 3, supply passages 60 to 64 for supplying lubricating oil for the internal combustion engine, which is lubricating fluid, into the sprocket 11 are formed in the sprocket 11 and the output shaft 16. Specifically, the supply passage 60 is formed in an annular shape continuously extending around the rotational axis "O" of the sprocket 11 and is open to the inner wall surface of the connection portion 14 of the sprocket 11, thereby communicating with the inside of the sprocket 11. The supply passage 61 extending in the axial direction in the shaft portion 12 of the sprocket 11 communicates with the supply passage 60 at one end in the axial direction and is open to the inner peripheral surface of the shaft portion 12 fitted on the output shaft 16. The supply passage 62, which is open to the outer peripheral surface of the output shaft 16 fitted in the shaft portion 12 is formed in an annular shape continuously extending around the rotational axis "O" of the output shaft 16 and can always communicate with the supply passage 61 of the sprocket 11. The supply passage 63 passing through the output shaft 16 in the axial direction communicates with an introduction passage 6 through which lubricating oil is introduced into the camshaft 2 fixed to the output shaft 16. The supply passage 64 passing through the output shaft 16 in the radial direction communicates with the supply passages 62 and 63.

A discharge passage 66 for discharging the lubricating oil from inside the sprocket 11 to the outside is formed in the cover part 15 of the sprocket 11. The discharge passage 66 of this embodiment is formed in such a manner as to pass through the bottom wall of the cover part 15 in the axial direction.

With the above-mentioned construction, the lubricating oil introduced into the introduction passage 6 of the camshaft 2 is passed through the supply passages 63, 64, and 62 of the output shaft 16 and the supply passages 61, 60 of the sprocket 11 in succession and is supplied into the sprocket 11. This supplied lubricating oil lubricates the planetary gear mechanism 40, the link mechanism 50, and the like in the sprocket 11, thereby being brought into the state of containing foreign matter of wear powder and the like. The lubricating oil containing such foreign matter receives the hydraulic pressure of the lubricating oil successively supplied into the sprocket 11, thereby being discharged from the discharge passage 66 to the outside of the sprocket 11. That is, the lubricating oil in the sprocket 11 can be replaced in succession.

Next, parts characteristic of the planetary gear 43 according to the first embodiment will be described.

Figure 7:
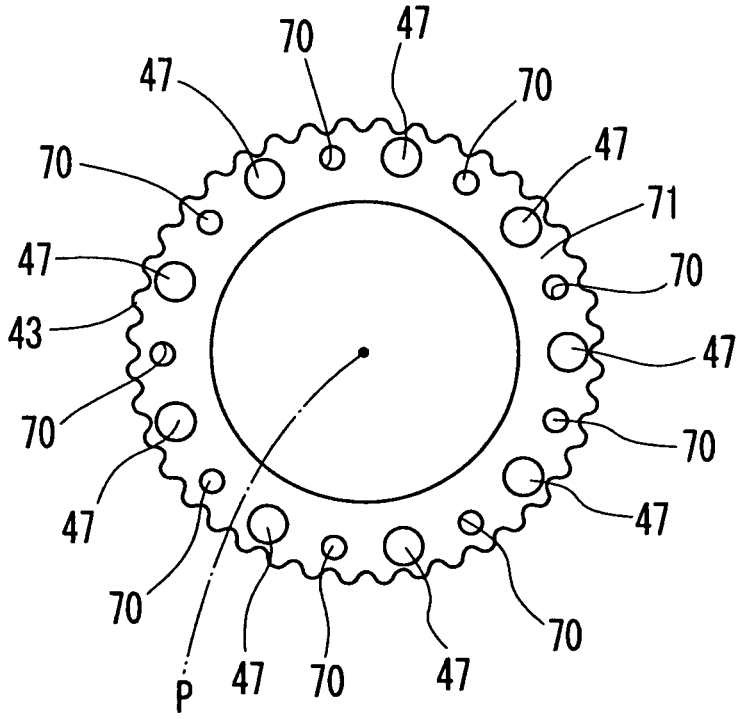
FIG. 7 is a rear view showing a planetary gear of the first embodiment and is a view corresponding to a view when viewed from an arrow VII-VII in FIG. 2.
Figure 8:
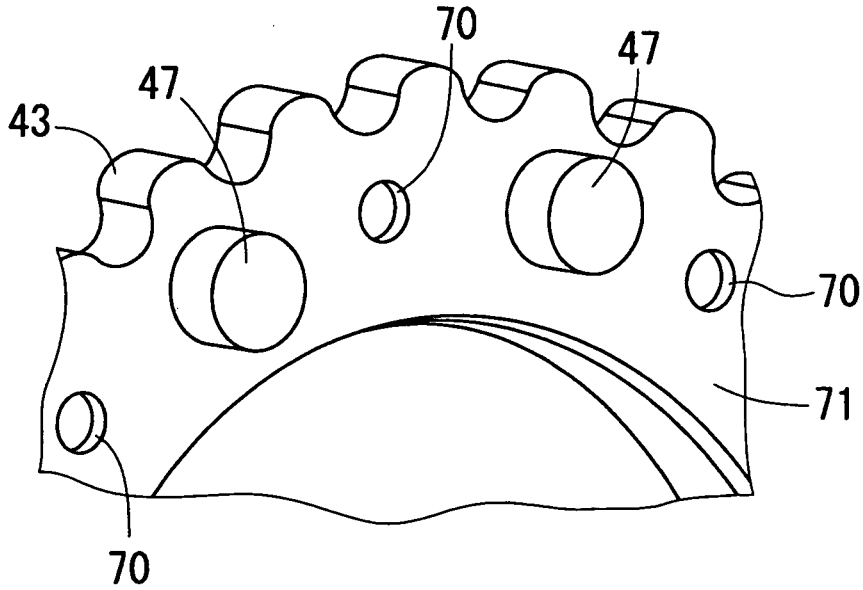
FIG. 8 is a perspective view showing a rear side of the planetary gear according to the first embodiment.

As shown in FIGS. 1, 7, and 8, in the planetary gear 43, a plurality of cylindrical holes 70 each closed at one end are formed at a plurality of portions between the respective engaging protrusions 47. These cylindrical holes 70 are arranged at equal intervals around the rotational axis "P" of the planetary gear 43. Each hole 70 closed at one end is open to one surface 71 in the axial direction of the planetary gear 43 but is not open to the other surface 72 in the axial direction of the planetary gear 43. Here, the surface 71 of the planetary 43 is brought into sliding contact with a surface 73 opposite to the guide rotary body 54 of the transmission rotary body 45. Hence, the hole 70 closed at one end of this embodiment is open to the surface 71 in sliding contact with the transmission rotary body 45 of the planetary gear 43 and has a bottom surface 75 as a stepwise surface more depressed than the sliding surface 71.

Figure 9:
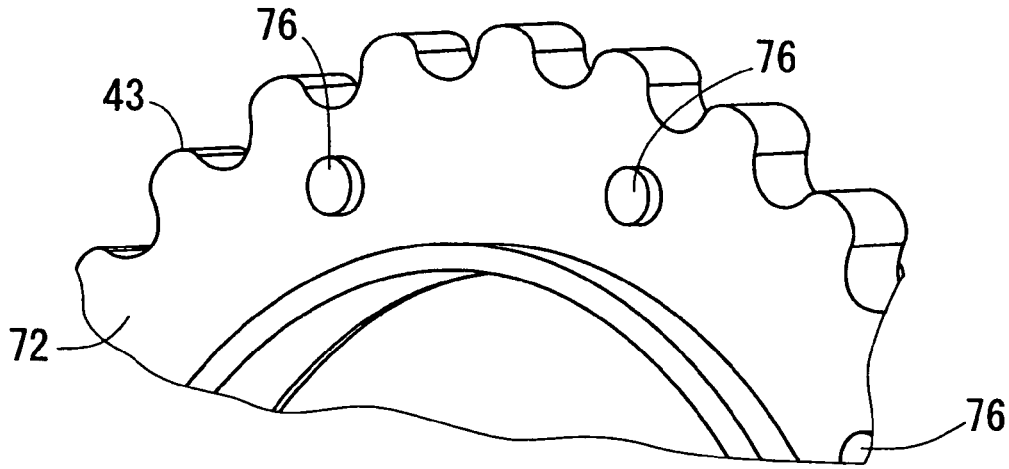
FIG. 9 is a perspective view showing a front side of the planetary gear according to the first embodiment.

Moreover, as shown in FIGS. 1, 5, and 9, a plurality of sliding contact protrusions 76 each shaped like a circular column are formed at a plurality of positions corresponding to the respective holes 70 closed as one end in the axial direction. These sliding contact protrusions 76 are also arranged at equal intervals around the rotational axis "P" of the planetary gear 43. Each of the sliding contact protrusions 76 is protruded from the surface 72 of the planetary gear 43 in the axial direction and the tip surfaces 77 of the respective sliding contact protrusions 76 are brought into sliding contact with the bottom wall surface 78 of the cover part 15 of the sprocket 11.

According to the first embodiment like this, as shown in FIG. 1, spaces 80 of the planetary gear 43, which are formed on the inner peripheral side by the respective holes 70 each closed at one end of the planetary gear 43 and are sandwiched between the bottom surface 75 and the transmission rotary body 45, exist at an interface where the planetary gear 43 is brought into sliding contact with the transmission rotary body 45, so that the contact area of these elements 43 and 45 become small. Hence, even if the lubricating oil in the sprocket 11 flows into the interface between the planetary gear 43 and the transmission rotary body 45 with its viscosity increased at the time of low temperature or the like, it is possible to restrict an increment in the sliding resistance between these elements 43 and 45. Moreover, as shown in FIG. 1, spaces 82 exist on the outer peripheral side of the respective sliding contact protrusions 76 at an interface where the planetary gear 43 is brought into sliding contact with the sprocket 11, so that the contact area of the planetary gear 43 and the sprocket 11 becomes small. Hence, even if the lubricating oil in the sprocket 11 flows into the interface between the planetary gear 43 and the sprocket 11 with its viscosity increased, it is possible to restrict the increment in the sliding resistance between these elements 43 and 41.

Figure 10:
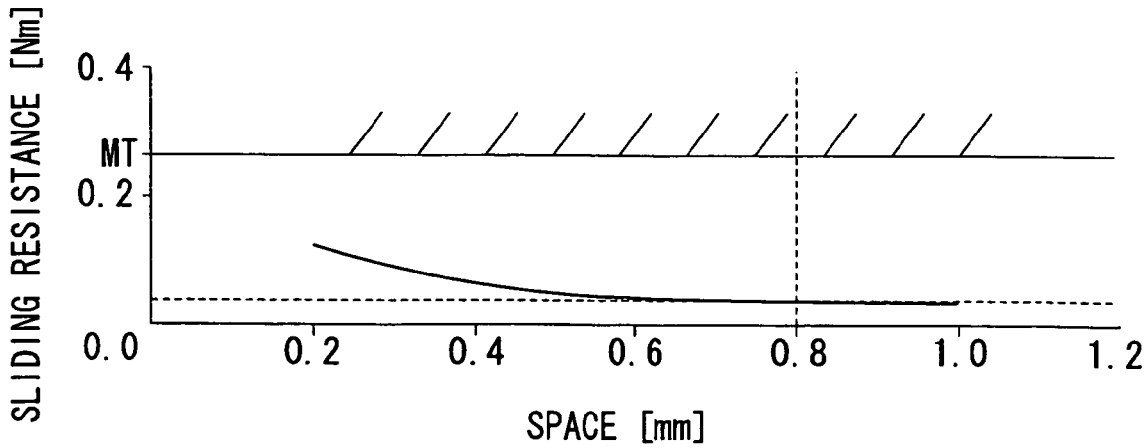
FIG. 10 is a schematic view showing the characteristics of the valve timing controller according to the first embodiment.

Here, FIG. 10 shows the correlation between the size of the space 82 in the axial direction of the planetary gear 43 and the sprocket 11 and the sliding resistance between these elements 43 and 11. According to this correlation, it is found that the space 82 make the sliding resistance between the elements 43 and 11 smaller than control torque MT produced by the electric motor 30 and that in particular, when the size of the space 82 and the space 80 (a gap clearance in the axial direction) is 0.8 mm or more, the sliding resistance can be reduced to a sufficiently small value.

Furthermore, according to the first embodiment, the plurality of holes 70 each closed at one end are arranged at equal intervals around the rotational axis "P" of the planetary gear 43 brought into sliding contact with the transmission rotary body 45, so that the sliding resistance produced at the interface between the planetary gear 43 and the transmission rotary body 45 is hard to be unbalanced around the rotational axis "P". Hence, it is possible to prevent the planetary gear 43 and the transmission body 45 from being inclined. Moreover, the sliding contact protrusions 76 brought into sliding contact with the sprocket 11 are arranged at equal intervals around the rotational axis "P" of the planetary gear 43, so that the sliding resistance is produced uniformly around the rotational axis "P" at the interface between the planetary gear 43 and the sprocket 11. Hence, it is possible to prevent the planetary gear 43 and the sprocket 11 from being inclined.

As described above, according to the first embodiment in which the sliding resistances between the elements 43, 45, and 11 can be reduced to small values and in which these elements can be prevented from being inclined, it is possible to prevent the malfunction of the planetary gear mechanism 40 and to reduce the size of the electric motor 30 by reducing electric power supplied to the electric motor 30.

Hereinafter, the other embodiments of the present invention will be described. In the descriptions, the substantially same constituent parts as those in the embodiments before modification are denoted by the same reference symbols and the descriptions of the constituent parts will be omitted.

Second Embodiment

Figure 11:
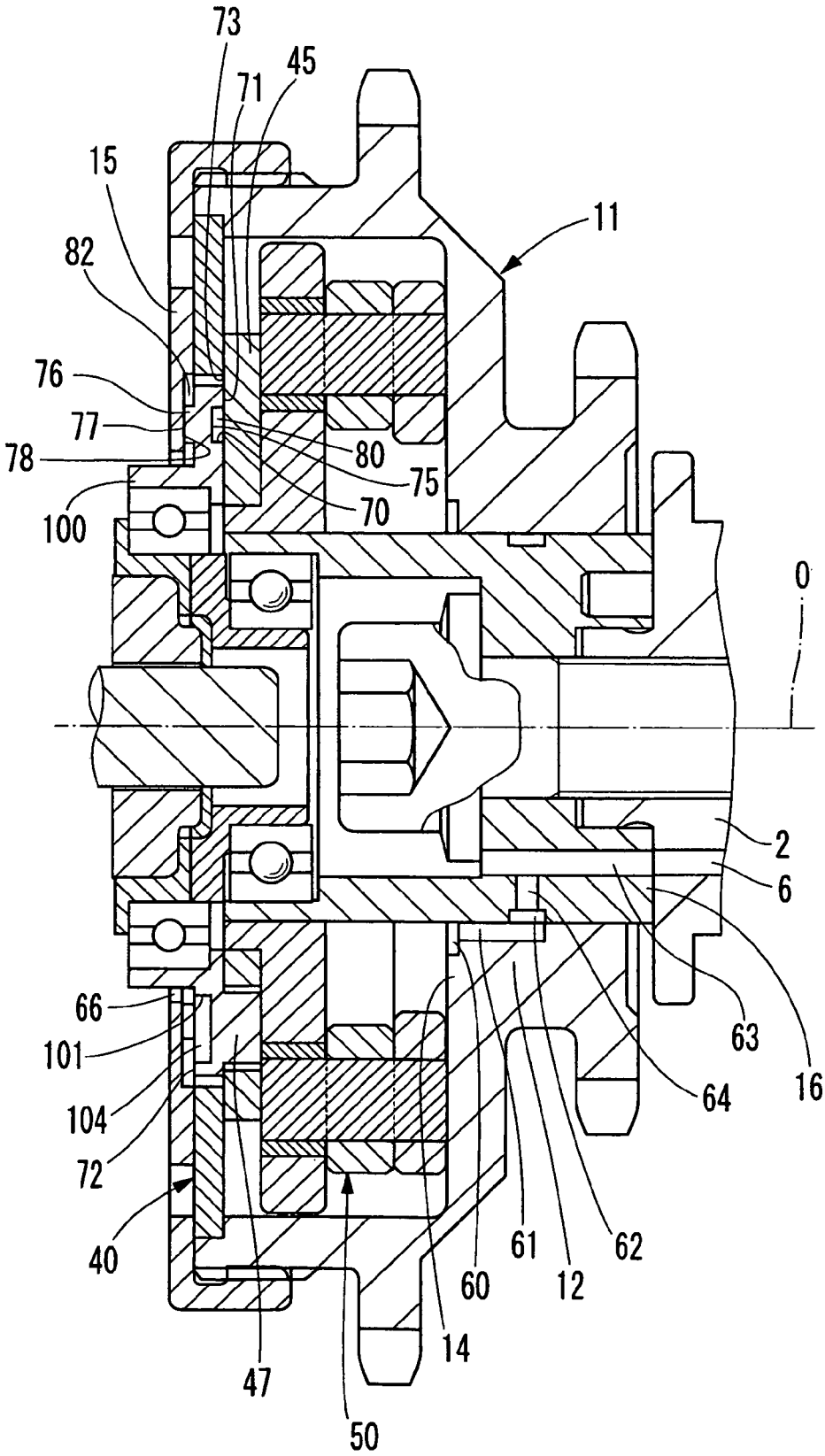
FIG. 11 is an enlarged cross-sectional view showing a valve timing controller according to a second embodiment.
Figure 12:
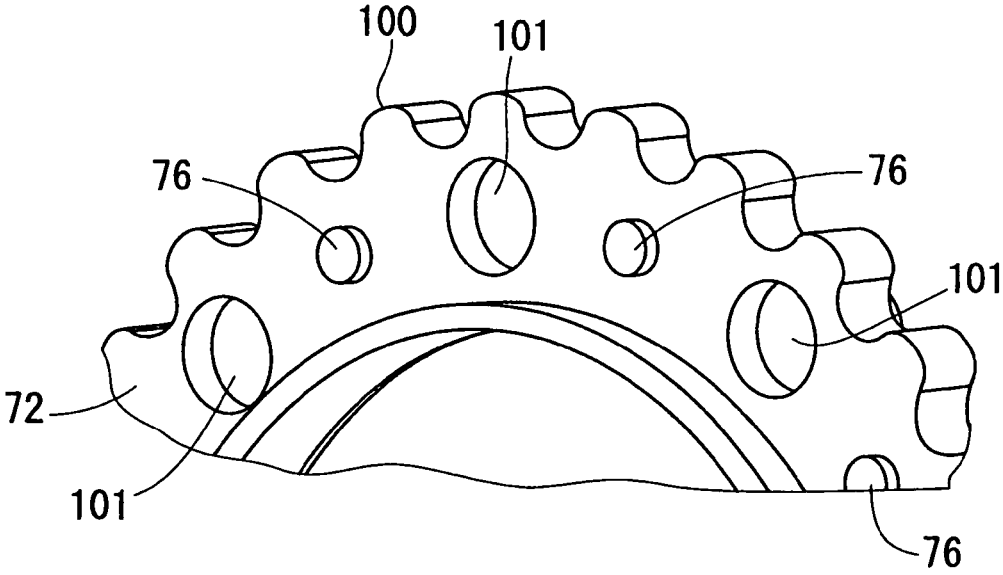
FIG. 12 is a perspective view showing a front side of a planetary gear according to the second embodiment.

As shown in FIGS. 11 and 12, a second embodiment is a modification example of the first embodiment.

In a planetary gear 100 of the second embodiment, in addition to the same construction as the first embodiment, a plurality of cylindrical holes 101 each closed at one end are formed at a plurality of positions corresponding to the respective engaging protrusions 47 in the axial direction. These holes 101 each closed at one end are arranged at equal intervals around the rotational axis "P" of the planetary gear 100. Each hole 101 closed at one end is open to the surface 72 opposite to the cover part 15 of the sprocket 11 across the space 82 to form a space 104 on the inner peripheral side.

According to the second embodiment, not only the spaces 82 but also the spaces 104 are formed at the interface where the planetary gear 100 is brought into sliding contact with the sprocket 11. Hence, it is possible to enhance the effect of inhibiting the sliding resistance between the planetary gear 100 and the sprocket 11 from increasing.

Third Embodiment

Figure 14:
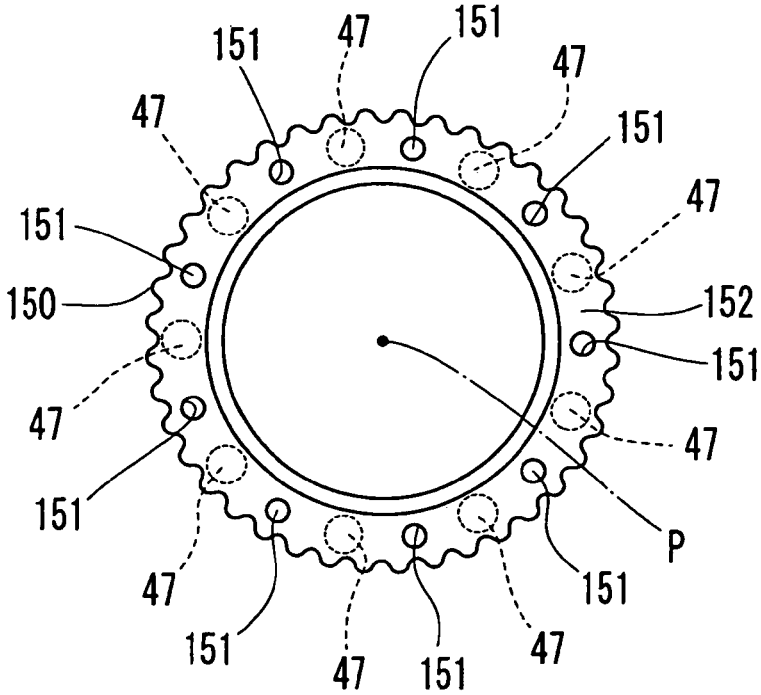
FIG. 14 is a front view showing a planetary gear according to the third embodiment.
Figure 13:
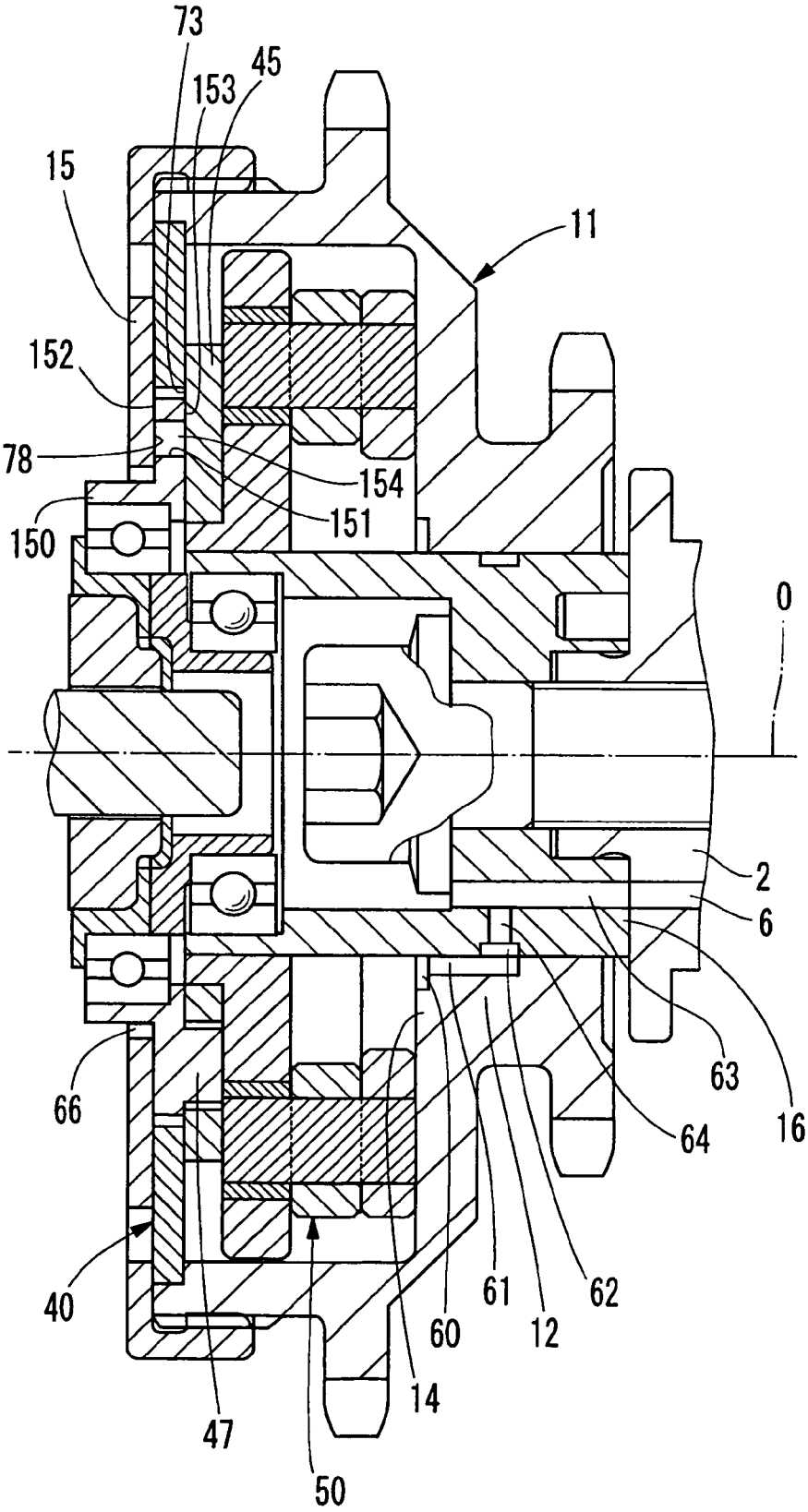
FIG. 13 is an enlarged cross-sectional view showing a valve timing controller according to a third embodiment.

As shown in FIGS. 13 and 14, a third embodiment is a modification example of the first embodiment.

In a planetary gear 150 of the third embodiment, a plurality of through holes 151 are formed in place of the holes 70 each closed at one end and the sliding contact protrusions 76. In the planetary gear 150, the through holes 151 are formed at a plurality of positions between the respective engaging protrusions 47. These through holes 151 are arranged at equal intervals around the rotational axis "P". Each through hole 151 passes through the planetary gear 150 in the axial direction and is open to the both surfaces 152 and 153 in the axial direction of the planetary gear 150. Here, one surface 152 of the planetary gear 150 is brought into sliding contact with the bottom wall surface 78 of the cover part 15 of the sprocket 11 and the other surface 153 of the planetary gear 150 is brought into sliding contact with the surface 73 of the transmission rotary body 45. Hence, the through holes 151 of this embodiment are open to both of the surface 152 of the planetary gear 150 where the planetary gear 150 is brought into sliding contact with the cover part 15 and the surface 153 of the planetary gear 150 where the planetary gear 150 is brought into sliding contact with the transmission rotary body 45.

According to the third embodiment, as shown in FIG. 13, spaces 154 formed on the inner peripheral side by the respective through holes 151 of the planetary gear 150 exist at the interface where the planetary gear 150 is brought into sliding contact with the elements 11 and 45 on both sides in the axial direction of the planetary gear 150. With this, the contact area of the planetary gear 150 and the elements 11, 45 on both sides in the axial direction becomes small. Hence, it is possible to prevent the sliding resistances between the planetary gear 150 and the elements 11, 45 from increasing irrespective of a change in the viscosity of the lubricating oil. Furthermore, the plurality of through holes 151 are arranged at equal intervals around the rotational axis "P" of the planetary gear 150 of the third embodiment, so that the sliding resistances produced at the interfaces between the planetary gear 150 and the elements 11, 45 on both sides in the axial direction are hard to be unbalanced around the rotational axis "P". Hence, it is possible to prevent the planetary gear 150 and the elements 11, 45 on both sides in the axial direction from being inclined.

Fourth Embodiment

Figure 15:
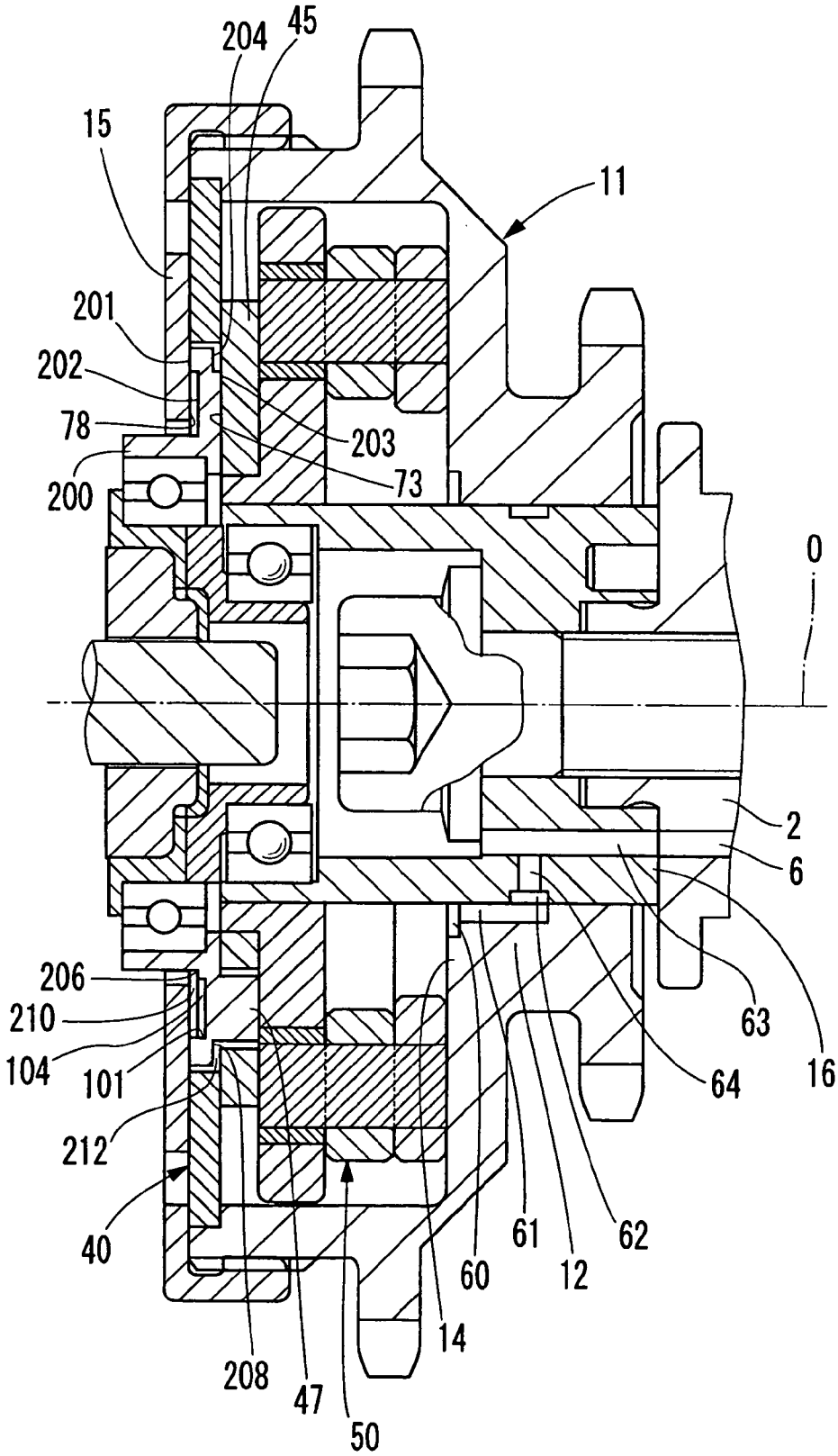
FIG. 15 is an enlarged cross-sectional view showing a valve timing controller according to a fourth embodiment.
Figure 16A:
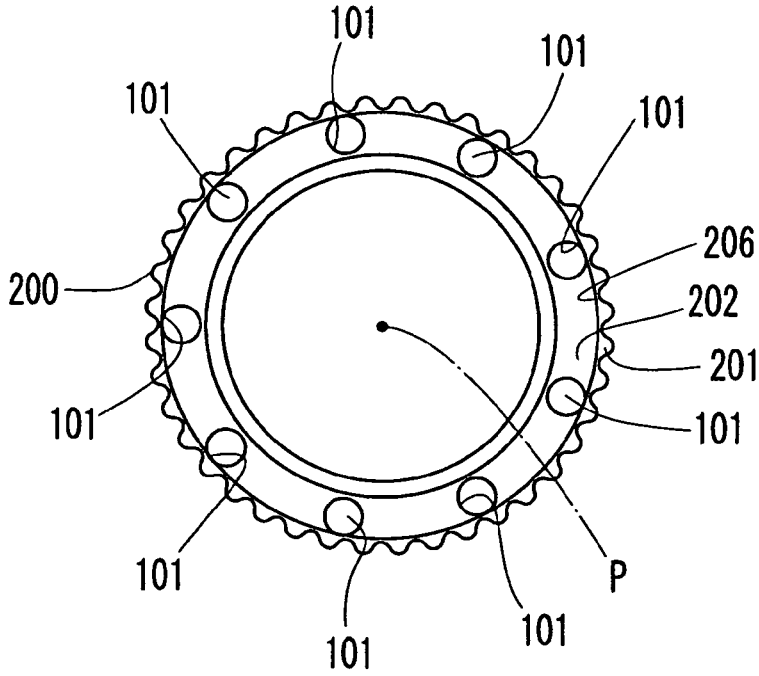
FIGS. 16A and 16B are a front view and a rear view showing a planetary gear according to the fourth embodiment, respectively.
Figure 16B:
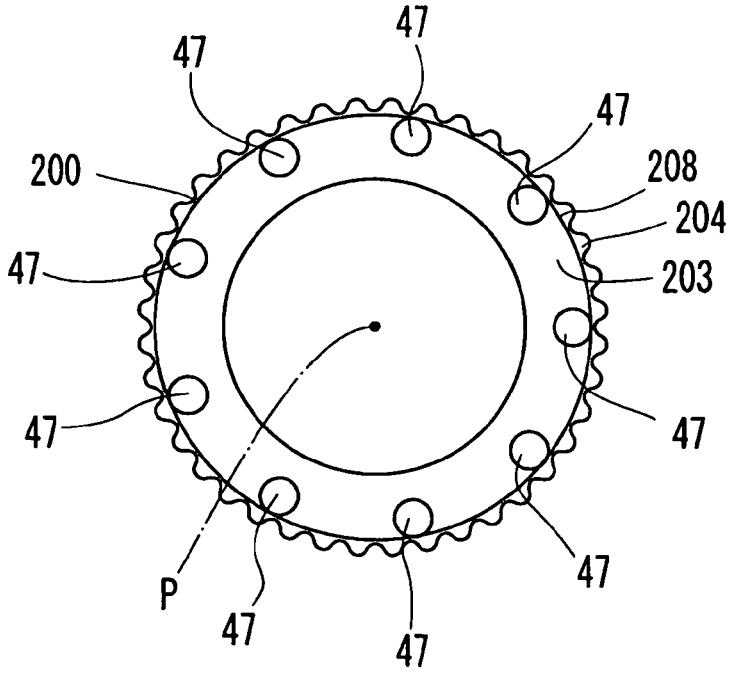

As shown in FIGS. 15 and 16, a fourth embodiment is a modification of the second embodiment.

In a planetary gear 200, a stepwise surface 202 that is more depressed than one surface 201 in the axial direction and a stepwise surface 204 that is more depressed than the other surface 203 in the axial direction are formed in place of the sliding contact protrusions 76. Here, the surface 201 of the planetary gear 200 is brought into contact with the bottom wall surface 78 of the cover part 15 of the sprocket 11 and the surface 203 of the planetary gear 200 is brought into contact with the surface 73 of the transmission rotary body 45. Hence, the stepwise surface 202 of this embodiment is more depressed than the surface 201 where the planetary gear 200 is brought into sliding contact with the cover part 15 and the stepwise surface 204 is more depressed than the surface 203 where the planetary gear 200 is brought into sliding contact with the transmission rotary body 45.

The stepwise surface 202 confronting the cover part 15 is formed of a bottom surface of an annular depressed portion 206 continuously extending around the rotational axis "P" of the planetary gear 200 and is open to portions except for portions forming teeth in the surface 201 of the planetary gear 200. A plurality of holes 101 each closed at one end are open to this stepwise surface 202. That is, the respective holes 101 each closed at one end are formed in the annular depressed portion 206.

In contrast, the stepwise surface 204 confronting the transmission rotary body 45 is formed of a bottom surface of an annular depressed portion 208 continuously extending around the rotational axis "P" of the planetary gear 200 and is open to portions forming teeth in the surface 203 of the planetary gear 200.

As shown in FIG. 15, a space 210, which is formed by the annular depressed portion 206 of the planetary gear 200 and is sandwiched between the stepwise surface 202 and the sprocket 11 and spaces 104, which are formed by the respective holes 101 each closed at one end, exist at the interface where the planetary gear 200 is brought into sliding contact with the sprocket 11. Hence, the contact area of the planetary gear 200 and the sprocket 11 becomes small. Moreover, a space 212, which is formed by the annular depressed portion 208 of the planetary gear 200 and is sandwiched between the stepwise surface 204 and the transmission rotary body 45, exists at the interface where the planetary gear 200 is brought into sliding contact with the transmission rotary body 45. Hence, the contact area of the planetary gear 200 and the transmission rotary body 45 becomes small. As described above, it is possible to prevent the sliding resistances between the planetary gear 200 and the elements 11, 45 on both sides in the axial direction of the planetary gear 200 from increasing irrespective of a change in the viscosity of the lubricating oil.

Furthermore, the stepwise surfaces 202 and 204 are formed in the planetary gear 200 in such a manner as to continuously extend around the rotational axis "P" of the planetary gear 200, so that the sliding resistances produced at the interfaces between the planetary gear 200 and the elements 11, 45 on both sides in the axial direction of the planetary gear 200 are hard to be unbalanced around the rotational axis "P". Hence, it is possible to prevent the planetary gear 150 and the elements 11, 45 on both sides in the axial direction of the planetary gear 200 from being inclined.

Fifth Embodiment

Figure 17:
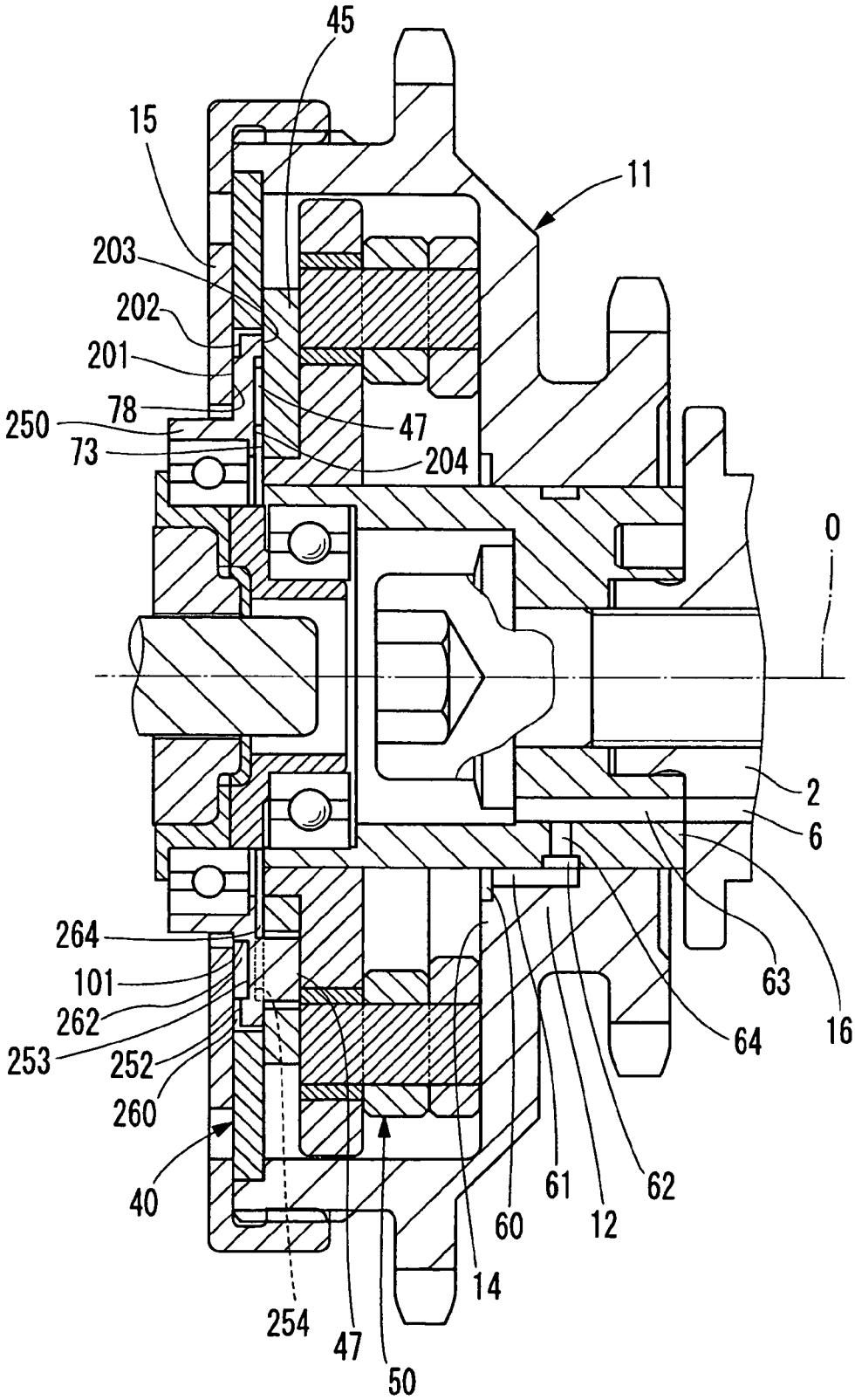
FIG. 17 is an enlarged cross-sectional view showing a valve timing controller according to a fifth embodiment.
Figure 18A:
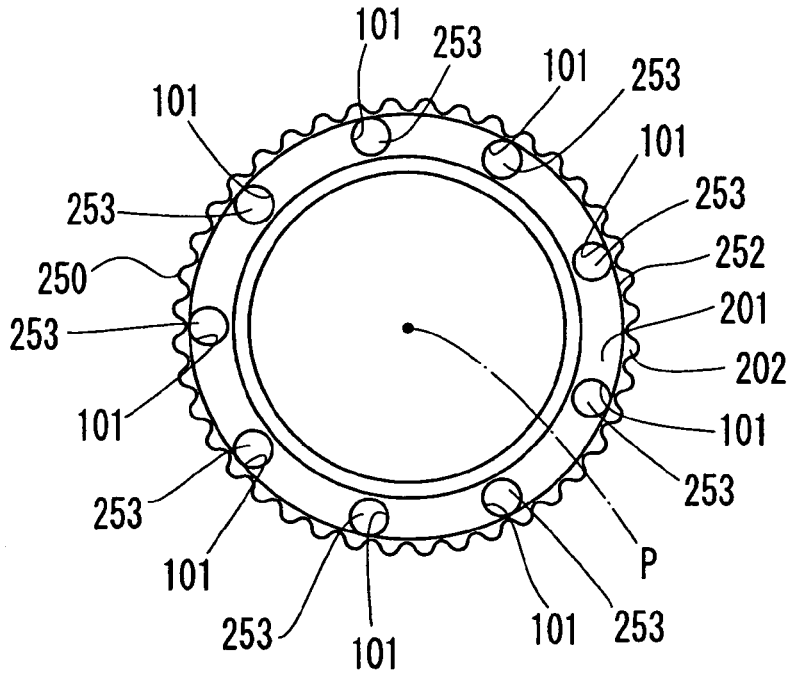
FIGS. 18A and 18B are a front view and a rear view showing a planetary gear according to a fifth embodiment, respectively.
Figure 18B:
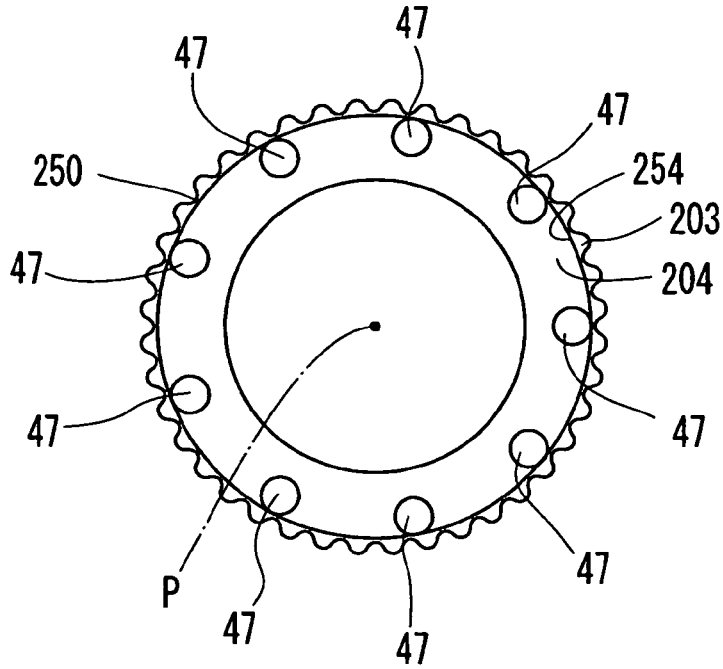

As shown in FIGS. 17 and 18, a fifth embodiment is a modification of the fourth embodiment.

In this embodiment, a stepwise surface 202 on the cover part 15 side of a planetary gear 250 is formed of the bottom surface of an annular depressed portion 252 continuously extending around the rotational axis "P" of the planetary gear 250 and is open to portions forming teeth in the surface 201 where the planetary gear 250 is brought into a sliding contact with the cover part 15 of the planetary gear 250. According to this, the plurality of holes 101 each closed at one end are formed in the outer portion of the annular depressed portion 252 and are open to the surface 201 of the planetary gear 250. That is, in each hole 101 closed at one end of this embodiment, the bottom surface 253 of the planetary gear 250, which is more depressed than the surface 201 where the planetary gear 250 is brought into sliding contact with the cover part 15, is also formed as a stepwise surface.

Moreover, a stepwise surface 204 on the transmission rotary body 45 side of the planetary gear 250 is formed of a bottom surface of an annular depressed portion 254 continuously extending around the rotational axis "P" of the planetary gear 250 and is open to portions except for portions forming teeth in the surface 203 where the planetary gear 250 is brought into a sliding contact with the transmission rotary body 45. A plurality of engaging protrusions 47 protrude from this stepwise surface 204.

As shown in FIG. 17, a space 260, which is formed by the annular depressed portion 252 of the planetary gear 250 and is sandwiched between the stepwise surface 202 and the sprocket 11, exist at the interface where the planetary gear 250 is brought into sliding contact with the sprocket 11. Moreover, as shown in FIG. 17, spaces 262 of the planetary gear 250, which are formed on the inner peripheral sides by the respective holes 101 each closed at one end and are sandwiched between the bottom surface 253 and the sprocket 11, exist at the interface where the planetary gear 250 is brought into sliding contact with the sprocket 11. Hence, these spaces 260 and 262 reduce the contact area of the planetary gear 250 and the sprocket 11.

Furthermore, as shown in FIG. 17, a space 264, which is formed by the annular depressed part 254 of the planetary gear 250 and is sandwiched between the stepwise surface 204 and the transmission rotary body 45, exist at the interface where the planetary gear 250 is brought into sliding contact with the transmission rotary body 45. Hence, the contact area of the planetary gear 250 and the transmission rotary body 45 becomes small.

As described above, it is possible to prevent the sliding resistances between the planetary gear 250 and the elements 11, 45 from increasing irrespective of a change in the viscosity of the lubricating oil.

Furthermore, the stepwise surfaces 202 and 204 continuously extending around the rotational axis "P" of the planetary gear 250 are formed. Hence, by the same principle as in the fourth embodiment, it is possible to prevent the planetary gear 250 and the elements 11, 45 on both sides in the axial direction from being inclined.

Sixth Embodiment

Figure 19:
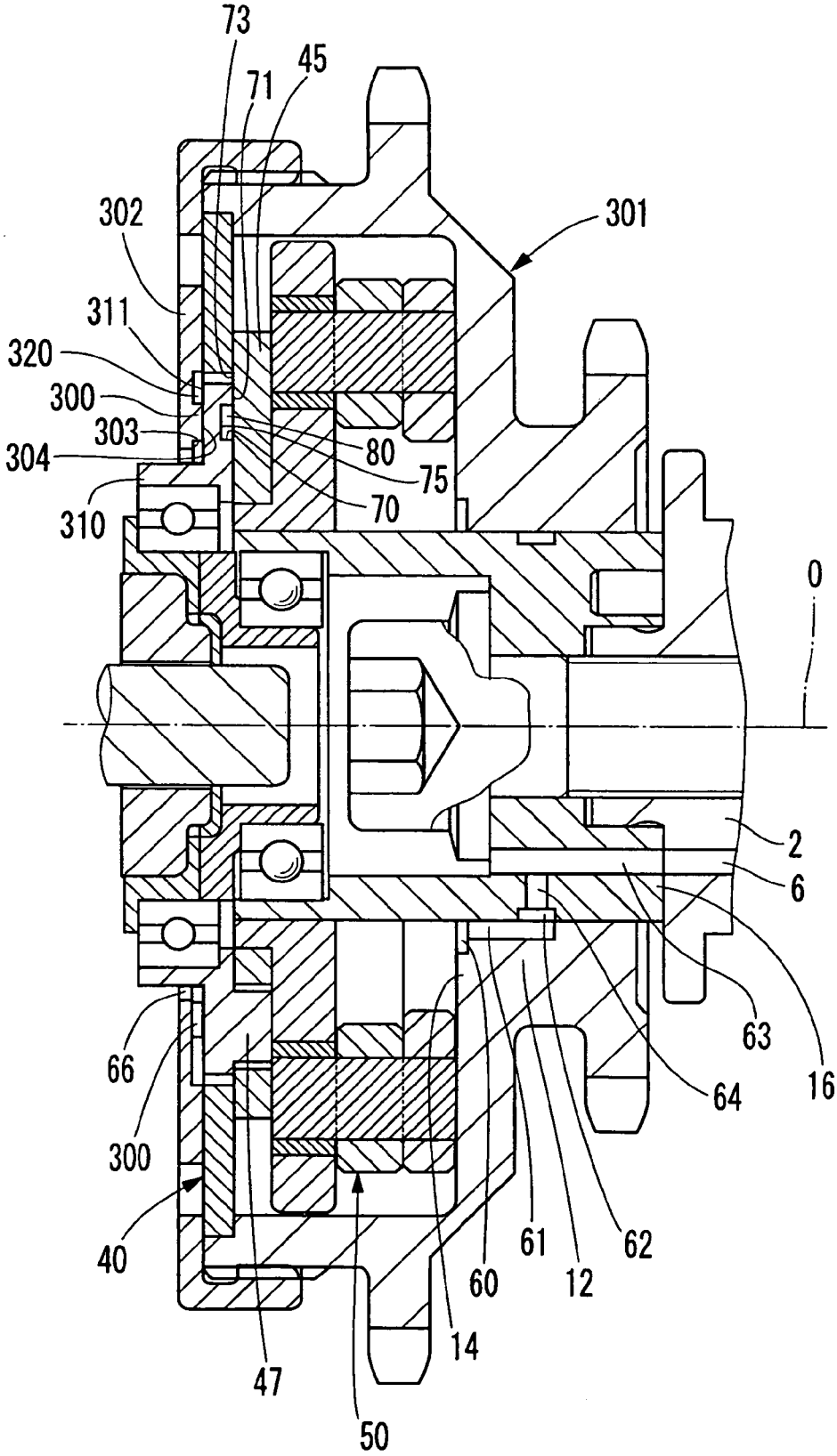
FIG. 19 is an enlarged cross-sectional view showing a valve timing controller according to a sixth embodiment.

As shown in FIG. 19, a sixth embodiment is a modification example of the first embodiment.

In the sixth embodiment, a plurality of sliding contact protrusions 300 are not formed on a planetary gear 310 but are formed on a cover part 302 of a sprocket 301 instead. Each of the sliding contact protrusions 300 arranged at equal intervals around the rotational axis "O" of the cover part 302 protrudes from the bottom wall surface 303 of the cover part 302 in the axial direction and the tip surfaces 304 of the respective sliding contact protrusion 300 are brought into sliding contact with a surface 311 opposite to the transmission rotary body 45 of the planetary gear 310.

According to the sixth embodiment like this, as shown in FIG. 19, a space 320 exists on the outer peripheral side of the respective sliding contact protrusions 300 at the interface where the planetary gear 310 is brought into sliding contact with the sprocket 301. Hence, the contact area of the planetary gear 310 and the sprocket 301 becomes small. Hence, it is possible to prevent the sliding resistances between these elements 310 and 301 from increasing irrespective of a change in the viscosity of the lubricating oil. Furthermore, the plurality of sliding contact protrusions 300 are formed at equal intervals around the rotational axis "O" of the sprocket 301 of the sixth embodiment, so that the sliding resistance is produced uniformly around the rotational axis "O" at the interface between the planetary gear 310 and the sprocket 301. Hence, it is possible to prevent the sprocket 301 and the planetary gear 310 from being inclined.

Seventh Embodiment

Figure 20:
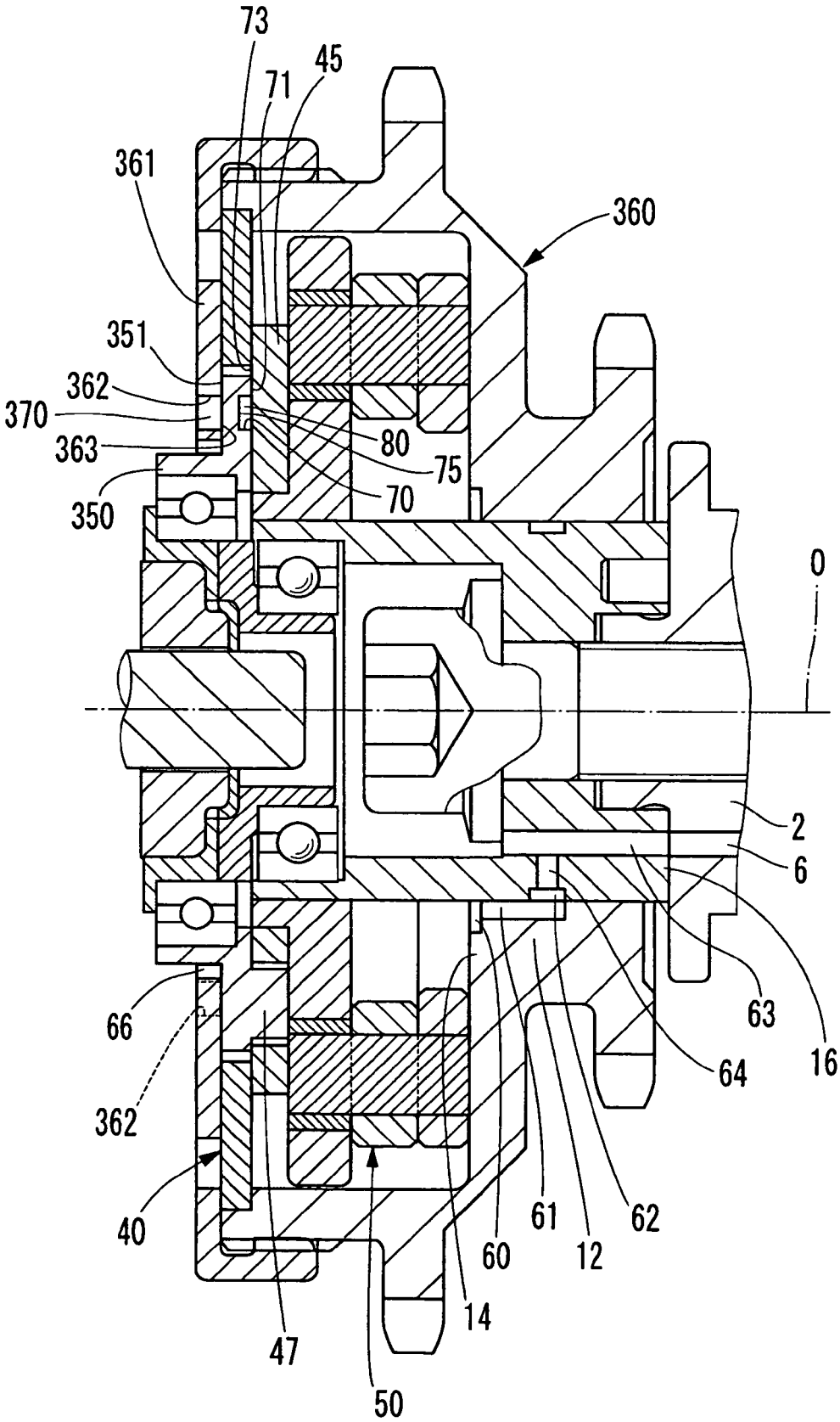
FIG. 20 is an enlarged cross-sectional view showing a valve timing controller according to a seventh embodiment.

As shown in FIG. 20, a seventh embodiment is a modification example of the first embodiment.

In the seventh embodiment, the sliding contact protrusions 76 are not formed on a planetary gear 350 but a plurality of through holes 362 are formed in a cover part 361 of a sprocket 360 instead. The plurality of through holes 362 are formed at equal intervals around the rotational axis of the cover part 361 and are passed through the bottom wall of the cover part 361 in the axial direction and are open to a bottom wall surface 363. Here, the bottom wall surface 363 of the cover part 361 is brought into sliding contact with a surface 351 opposite to the transmission rotary body 45 of the planetary gear 350. Hence, the through holes 362 of this embodiment are open to the surface 363 where the cover part 361 is brought into sliding contact with the planetary gear 350. Moreover, the through holes 362 of this embodiment make the inside of the sprocket 360 communicate with the outside thereof to enhance the function of discharging the lubricating oil in the sprocket 360.

According to the seventh embodiment like this, as shown in FIG. 20, spaces 370, which are formed on the inner peripheral side by the respective through holes 362 of the sprocket 360, exist at the interface where the planetary gear 350 is brought into sliding contact with the sprocket 360. With this, the contact area of the planetary gear 350 and the sprocket 360 becomes small, so that it is possible to inhibit the sliding resistance between these elements 350 and 360 from increasing irrespective of a change in the viscosity of the lubricating oil. Further, in the sprocket 360 of the seventh embodiment, the plurality of through holes 362 are formed at equal intervals around the rotational axis "O", so that the sliding resistance produced at the interface between the planetary gear 350 and the sprocket 360 is hard to be unbalanced around the rotational axis "O". Hence, it is possible to prevent the sprocket 360 and the planetary gear 350 from being inclined.

Eighth Embodiment

Figure 21:
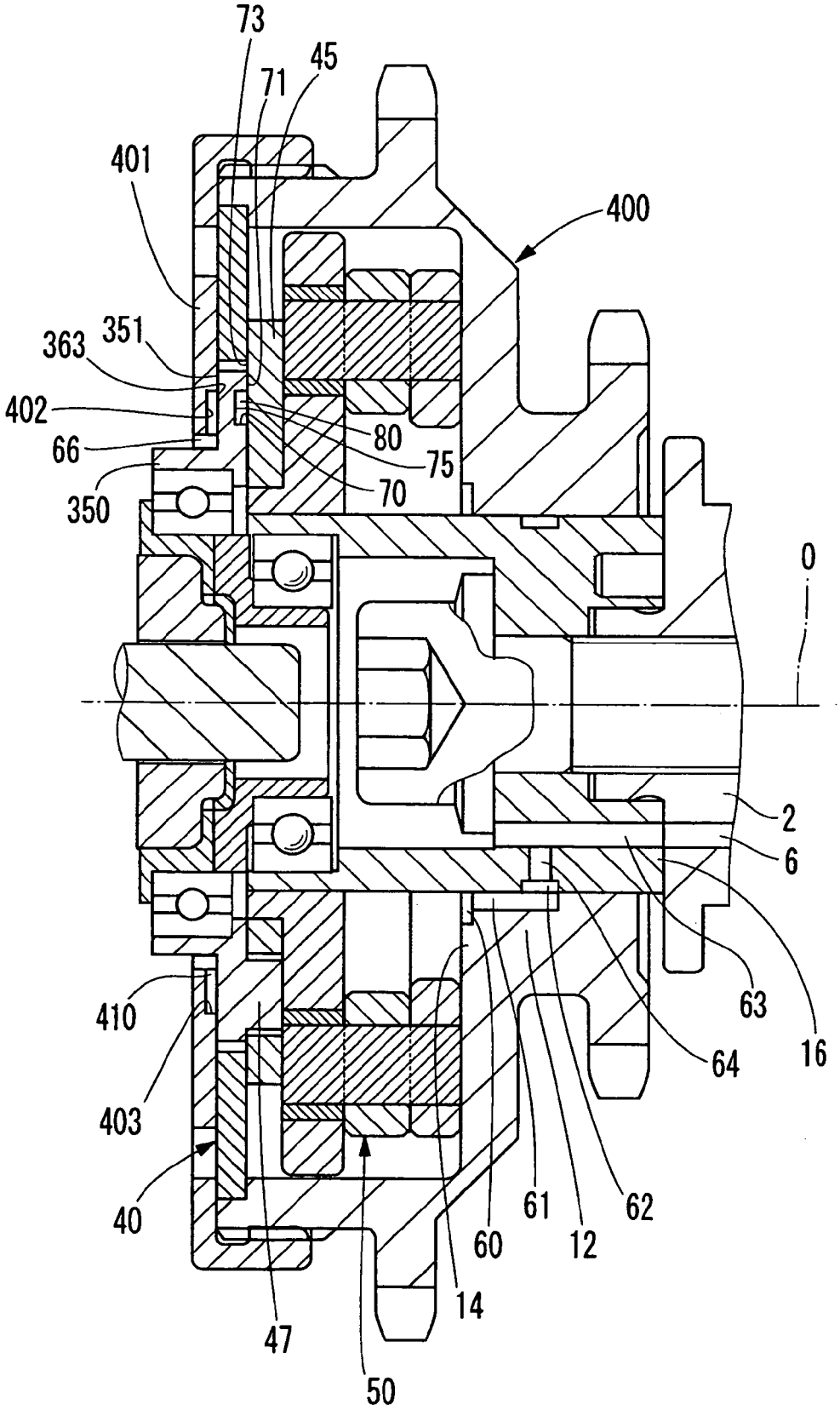
FIG. 21 is an enlarged cross-sectional view showing a valve timing controller according to an eighth embodiment.

As shown in FIG. 21, an eighth embodiment is a modification example of the seventh embodiment.

In the eighth embodiment, the through holes 362 are not formed in the cover part 401 of a sprocket 400 but a stepwise surface 402, which is more depressed than the surface 363 where a cover part 401 is brought into sliding contact with the planetary gear 350, is formed instead in the cover part 401 of the sprocket 400. This stepwise surface 402 is formed of the bottom surface of an annular depressed portion 403 continuously extending around the rotational axis of the cover part 401 and is formed on the outer peripheral side of the discharge passage 66.

According to the eighth embodiment, as shown in FIG. 21, a space 410, which is formed on the inner peripheral side by the annular depressed portion 403 of the planetary gear 350 and is sandwiched between the stepwise surface 402 and the planetary gear 350, exists at the interface where the planetary gear 350 is brought into sliding contact with the sprocket 400. With this, the contact area of the planetary gear 350 and the sprocket 400 becomes small, so that it is possible to inhibit the sliding resistance between these elements 350 and 400 from increasing irrespective of a change in the viscosity of the lubricating oil. Furthermore, the stepwise surface 402 is formed in the sprocket 400 of the eighth embodiment in such a way as to continuously extend around the rotational axis "O", so that the sliding resistance produced at the interface between the planetary gear 350 and the sprocket 400 is hard to be unbalanced around the rotational axis "O". Hence, it is possible to prevent the sprocket 360 and the planetary gear 350 from being inclined.

Ninth Embodiment

Figure 22:
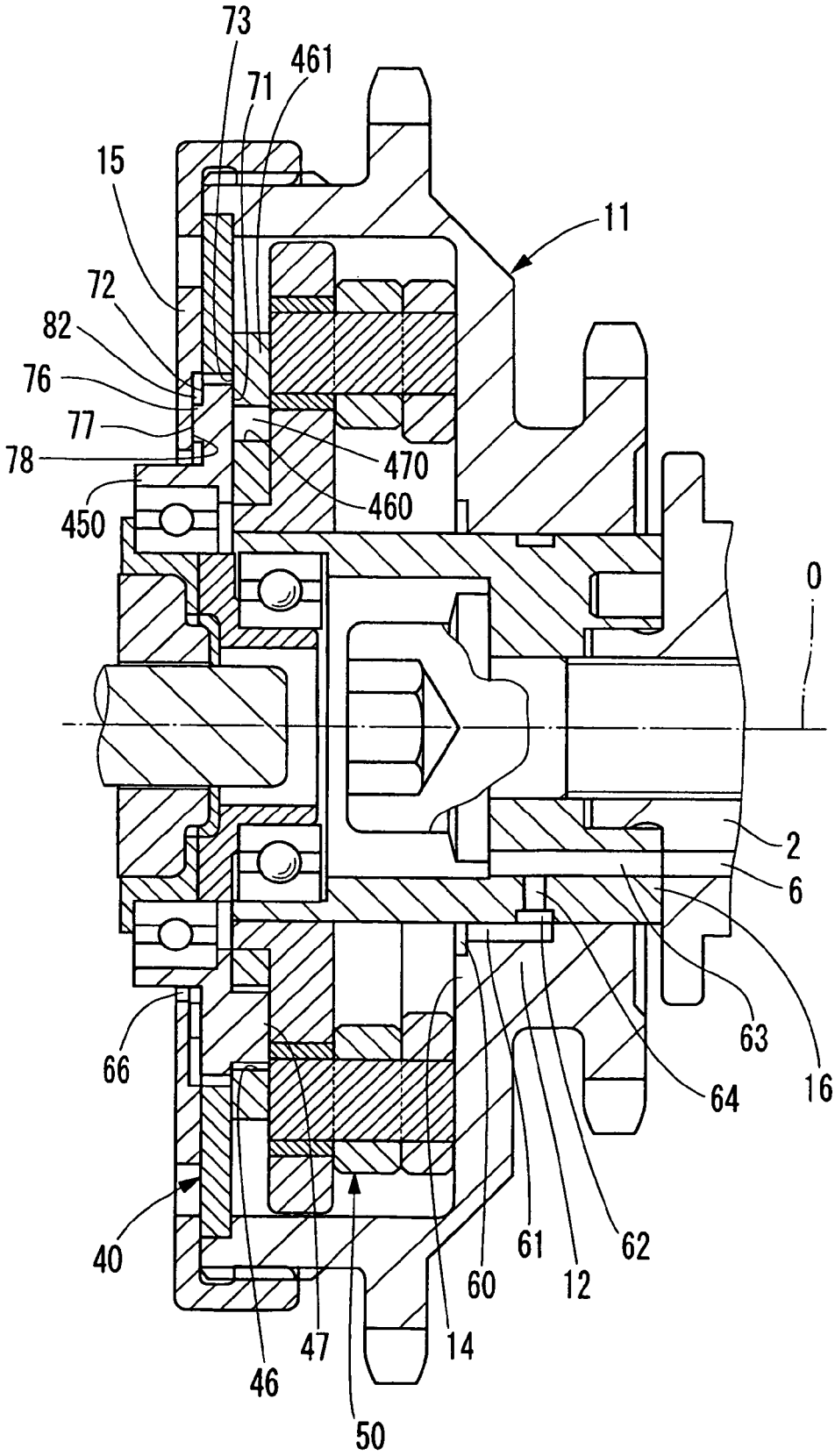
FIG. 22 is an enlarged cross-sectional view showing a valve timing controller according to a ninth embodiment.

As shown in FIG. 22, a ninth embodiment is a modification example of the first embodiment.

In the ninth embodiment, the holes 70 each closed at one end are not formed in a planetary gear 450 but a plurality of through holes 460 are formed in a transmission rotary body 461 instead. The plurality of through holes 460 are formed at a plurality of positions between the respective engaging holes 46 in the transmission rotary body 461. These through holes 460 are arranged at equal intervals around the rotational axis "O". Each of the through holes 460 passes through the transmission rotary body 461 in the axial direction and is open to the surface 73 where the transmission rotary body 461 is brought into sliding contact with the planetary gear 450.

According to the ninth embodiment like this, as shown in FIG. 22, spaces 470, which are formed on the inner peripheral side by the respective through holes 460 of the transmission rotary body 461, exist at the interface where the planetary gear 450 is brought into sliding contact with the transmission rotary body 461. With this, the contact area of the planetary gear 450 and the transmission rotary body 461 becomes small, so that it is possible to inhibit the sliding resistance between these elements 450 and 461 from increasing irrespective of a change in the viscosity of the lubricating oil. Further, in the transmission rotary body 461 of the ninth embodiment, the plurality of through holes 460 are formed at equal intervals around the rotational axis "O", so that the sliding resistance produced at the interface between the planetary gear 450 and the transmission rotary body 461 is hard to be unbalanced around the rotational axis "O". Hence, it is possible to prevent the transmission rotary body 461 and the planetary gear 450 from being inclined.

Tenth Embodiment

Figure 23:
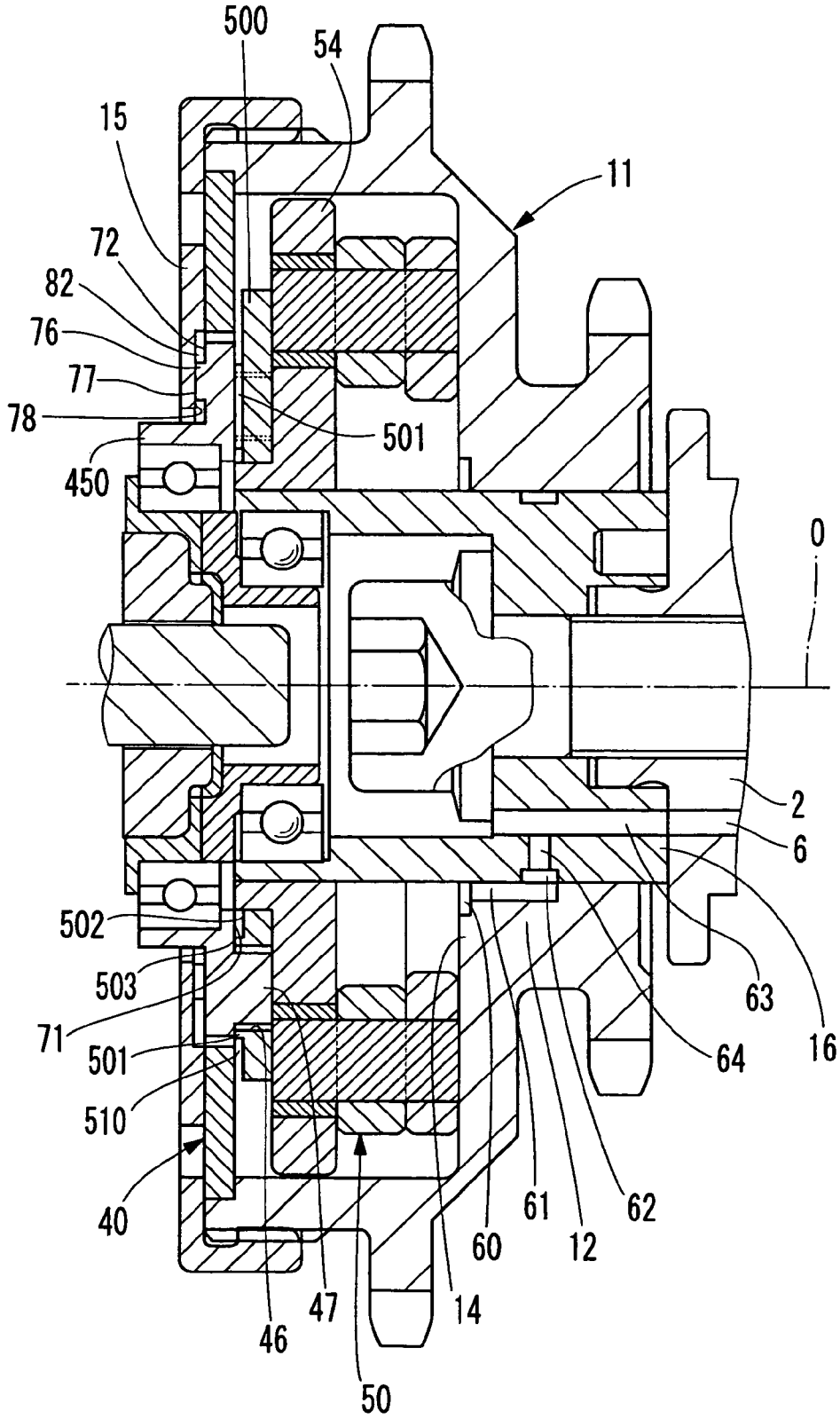
FIG. 23 is an enlarged cross-sectional view showing a valve timing controller according to a tenth embodiment.
Figure 24:
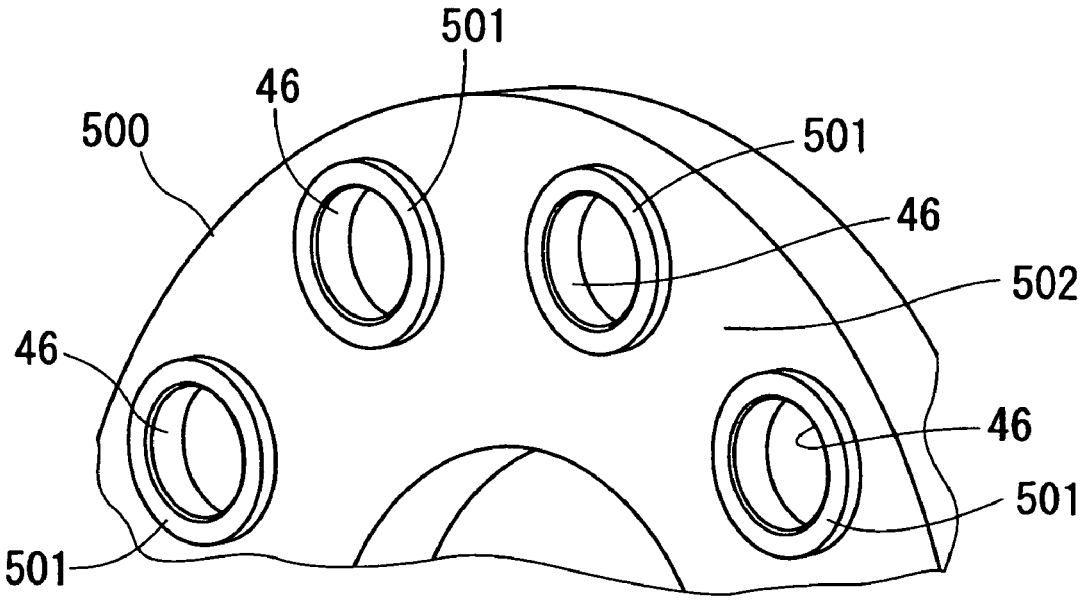
FIG. 24 is a perspective view showing a front side of a transmission rotary body according to the tenth embodiment.

As shown in FIGS. 23 and 24, a tenth embodiment is a modification example of the ninth embodiment.

A transmission rotary body 500 of the tenth embodiment has a plurality of sliding contact protrusions 501 formed thereon in place of the through holes 460. The plurality of sliding contact protrusions 501 are formed around the respective engaging holes 46. The plurality of sliding contact protrusions 501 are arranged at equal intervals around the rotational axis "O". Each of the sliding contact protrusions 501 protrudes from a surface 502 opposite to the guide rotary body 54 of the transmission rotary body 500 in the axial direction. The tip surfaces 503 of the respective sliding contact protrusions 501 are brought into sliding contact with the surface 71 opposite to the cover part 15 of the planetary gear 450. Moreover, each of the sliding contact protrusions 501 is formed coaxially with the engaging hole 46 corresponding thereto and in the shape of a cylinder having the same inside diameter as the engaging hole 46 and the corresponding engaging protrusion 47 of the planetary gear 450 is passed through each of the sliding contact protrusions 501.

According to the tenth embodiment like this, as shown in FIG. 23, spaces 510 exist on the outer peripheral sides by the respective sliding contact protrusions 501 at the interface where the planetary gear 450 is brought into sliding contact with the transmission rotary body 500, so that the contact area of the planetary gear 450 and the transmission rotary body 500 becomes small. Hence, it is possible to inhibit the sliding resistance between these elements 450 and 500 from increasing irrespective of a change in the viscosity of the lubricating oil. Further, in the transmission rotary body 500 of the tenth embodiment, the plurality of sliding contact protrusions 501 are formed at equal intervals around the rotational axis "O", so that the sliding resistance is produced uniformly around the rotational axis "O" at the interface between the planetary gear 450 and the transmission rotary body 500. Hence, it is possible to prevent the transmission rotary body 500 and the planetary gear 450 from being inclined.

Eleventh Embodiment

Figure 25:
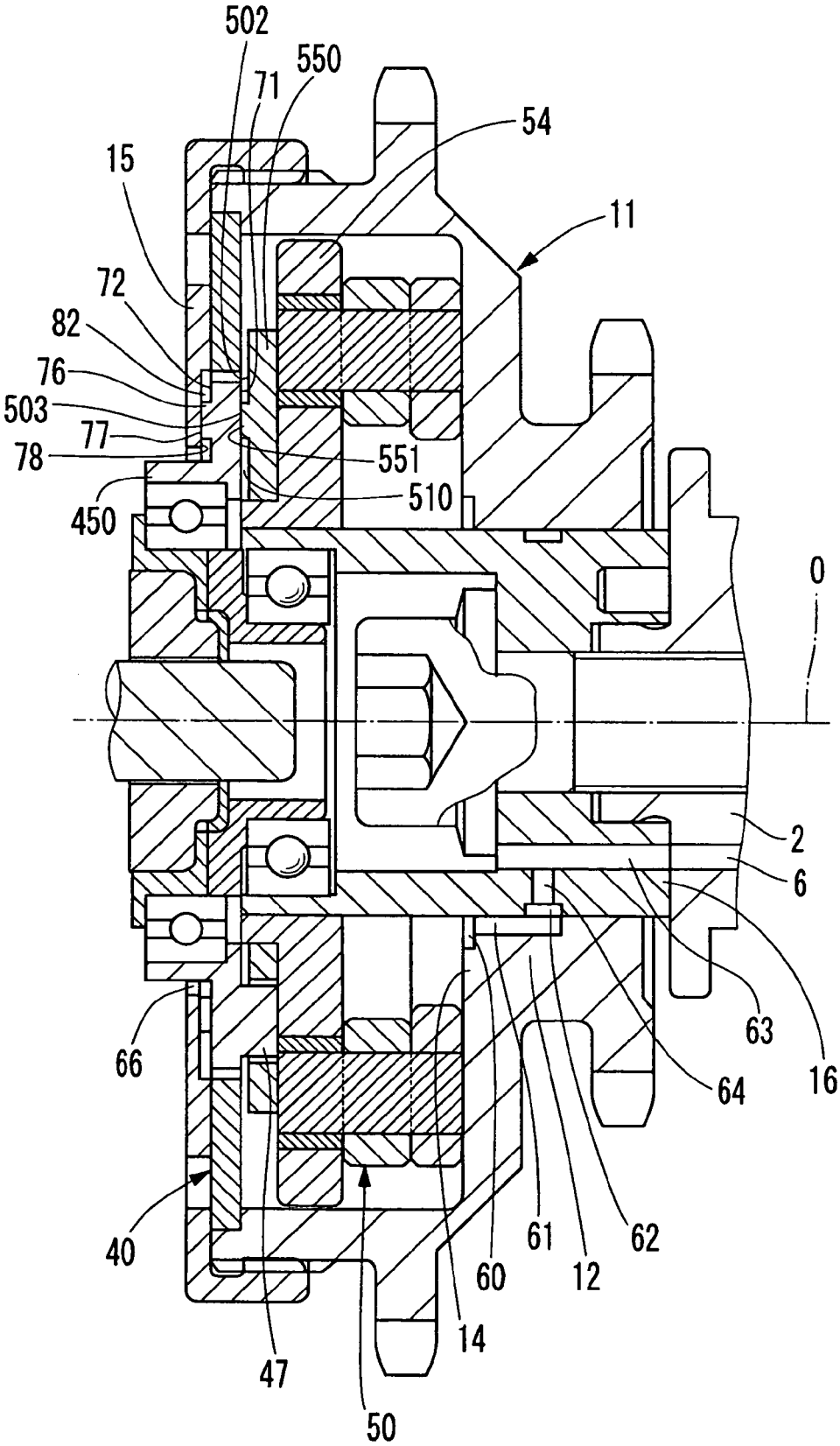
FIG. 25 is an enlarged cross-sectional view showing a valve timing controller according to an eleventh embodiment.

As shown in FIG. 25, an eleventh embodiment is a modification example of the tenth embodiment.

In a transmission rotary body 550 of the eleventh embodiment, a plurality of sliding contact protrusions 551 are formed at a plurality of positions between the respective engaging holes 46 and at equal intervals around the rotational axis "O" and each of the sliding contact protrusions 551 is formed in the shape of a cylindrical column. According to the eleventh embodiment like this, the spaces 510 are formed on the outer peripheral sides of the respective sliding contact protrusions 551, so that the eleventh embodiment can produce the same effect as the tenth embodiment.

Twelfth Embodiment

Figure 26:
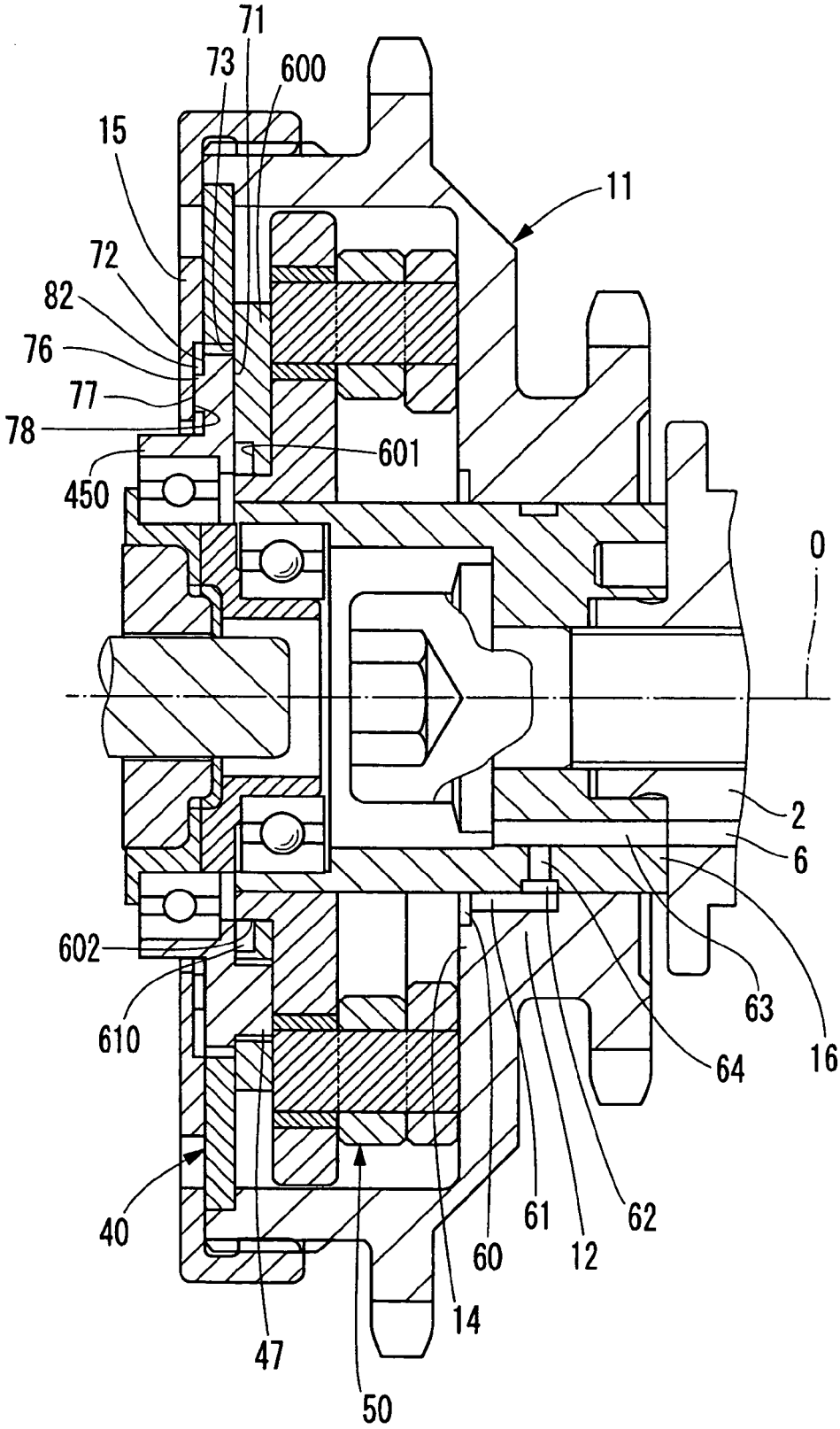
FIG. 26 is an enlarged cross-sectional view showing a valve timing controller according to a twelfth embodiment.

As shown in FIG. 26, a twelfth embodiment is a modification example of the ninth embodiment.

In the twelfth embodiment, the through holes 460 are not formed in a transmission rotary body 600 but a stepwise surface 601, which is more depressed than the surface 73 where the transmission rotary body 600 is brought into sliding contact with the planetary gear 450, is formed instead. This stepwise surface 601 is formed of a bottom surface of the annular depressed portion 602 continuously extending around the rotational axis "O" of the transmission rotary body 600 and is open to the portion on the inner peripheral side of the surface 73 of the transmission rotary body 600, as shown in FIG. 26.

According to the twelfth embodiment like this, as shown in FIG. 26, a space 610, which is formed on the inner peripheral side by the annular depressed portion 602 of the transmission rotary body 600 and is sandwiched between the stepwise surface 601 and the planetary gear 450, exists at the interface where the planetary gear 450 is brought into sliding contact with the transmission rotary body 600. With this, the contact area of the planetary gear 450 and the transmission rotary body 600 becomes small. Hence, it is possible to inhibit the sliding resistance between these elements 450 and 600 from increasing irrespective of a change in the viscosity of the lubricating oil. Further, in the transmission rotary body 600 of the twelfth embodiment, the stepwise surface 601 is formed in such a way as to continuously extend around the rotational axis "O", so that the sliding resistance produced at the interface between the planetary gear 450 and the transmission rotary body 600 is hard to be unbalanced around the rotational axis "O". Hence, it is possible to prevent the transmission rotary body 600 and the planetary gear 450 from being inclined.

Thirteenth Embodiment

Figure 27:
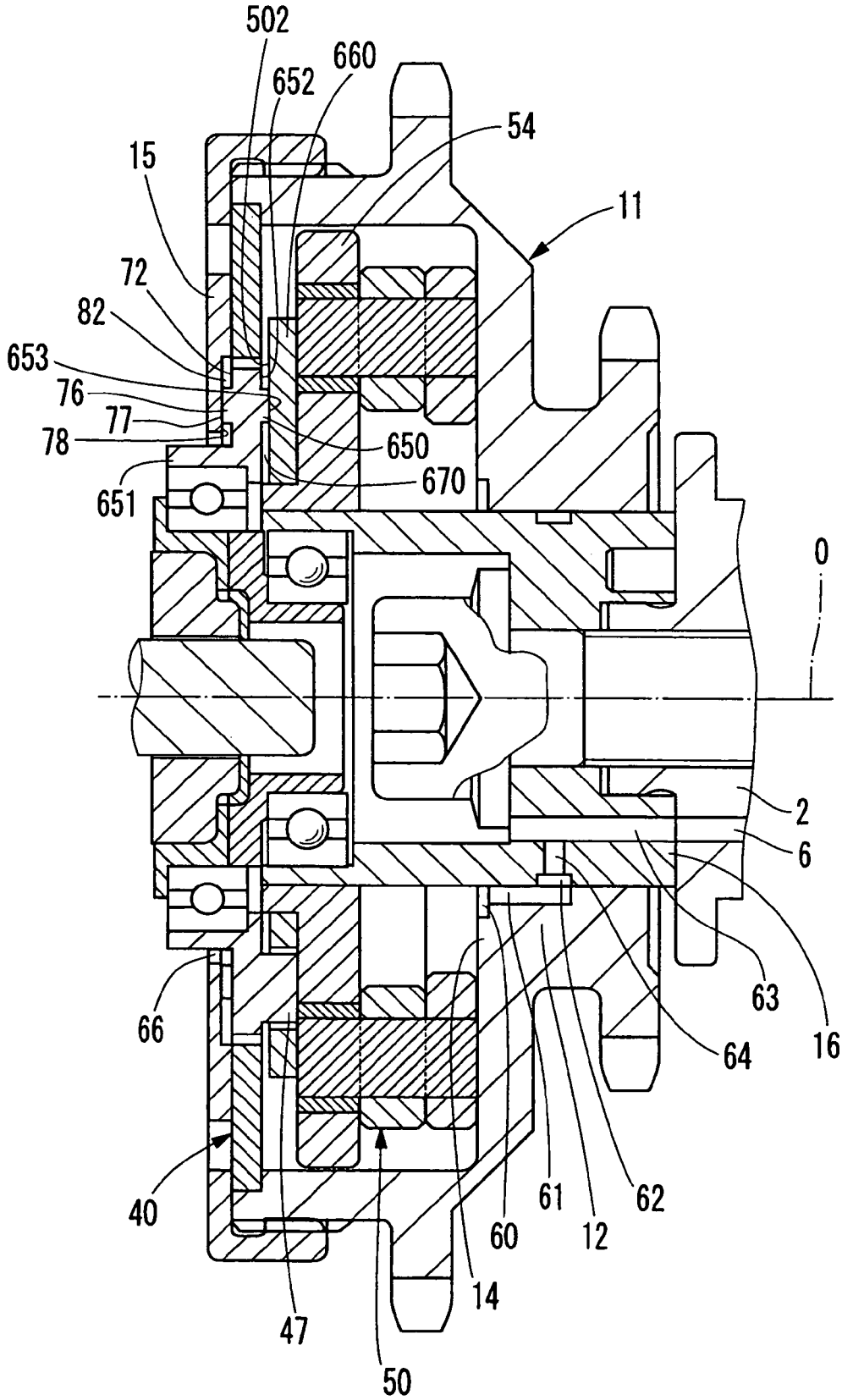
FIG. 27 is an enlarged cross-sectional view showing a valve timing controller according to a thirteenth embodiment.

As shown in FIG. 27, a thirteenth embodiment is a modification example of the eleventh embodiment.

In the thirteenth embodiment, a plurality of sliding contact protrusions 650 formed in the shape of a cylindrical column are not formed on a transmission rotary body 660 but are formed on the planetary gear 651 instead. In the planetary gear 651, the plurality of sliding contact protrusions 650 are formed at a plurality of positions between the respective engaging protrusions 47 and at equal intervals around the rotational axis "P". Each of the plurality of sliding contact protrusions 650 protrudes from a surface 652 opposite to the cover part 15 of the planetary gear 651 in the axial direction and the tip surfaces 653 of the respective sliding contact protrusions 650 are brought into sliding contact with the surface 502 opposite to the guide rotary body 54 of the transmission rotary body 660.

According to the thirteenth embodiment like this, as shown in FIG. 27, spaces 670 exist on the outer peripheral sides of the respective sliding contact protrusions 650 at the interface where the planetary gear 651 is brought into sliding contact with the transmission rotary body 660, so that the contact area of the planetary gear 651 and the transmission rotary body 660 becomes small. Hence, it is possible to inhibit the sliding resistance between these elements 651 and 660 from increasing irrespective of a change in the viscosity of the lubricating oil. Further, in the planetary gear 651 of the thirteenth embodiment, the plurality of sliding contact protrusions 650 are formed at equal intervals around the rotational axis "P", so that the sliding resistance is produced uniformly around the rotational axis "P" at the interface between the planetary gear 651 and the transmission rotary body 660. Hence, it is possible to prevent the planetary gear 651 and the transmission rotary body 660 from being inclined.

The present invention is not limited to these embodiments.

For example, in the first to the thirteenth embodiments, it is also recommended that the link mechanism 50 is not provided but that the transmission rotary body is coupled directly to or integrated with the output shaft 16.

Further, in the first to the thirteenth embodiments, it is also recommended that the construction between the planetary gear and the sprocket is appropriately combined with or replaced with the construction of the other embodiment or that the construction between the planetary gear and the transmission rotary body is appropriately combined with or replaced with the construction of the other embodiment. Furthermore, in the first to the thirteenth embodiments, it is also recommended that one of the construction between the planetary gear and the sprocket and the construction between the planetary gear and the transmission rotary body is not provided.

Still further, in the second to the thirteenth embodiments, by making the size in the axial direction of the spaces formed at the interface between the planetary gear and the sprocket and/or at the interface between the planetary gear and the transmission rotary body, for example, 0.8 mm or more according to the first embodiment, the effect of inhibiting the sliding resistance from increasing can be enhanced. In this regard, in the third, the seventh, and the ninth embodiments, by setting the thickness in the axial direction of the element, that is, the planetary gear 150, the bottom wall of the cover part 361, or the transmission rotary body 461, which forms the through holes surrounding the spaces, at 0.8 mm or more, the spaces each having a size of 0.8 mm or more in the axial direction can be easily secured.

Still further, in the seventh and ninth embodiments, in place of the through holes 362 or the through holes 460, it is also recommended that there are formed holes each of which is closed at one end and is open only to the surface 363 where the cover part 361 is brought into sliding contact with the planetary gear 350 or holes each of which is closed at one end and is open only to the surface 73 where the transmission rotary body 461 is brought into sliding contact with the planetary gear 450.

What is claimed is:

1. A valve timing controller for an internal combustion engine, the valve timing controller adjusting at least one of an intake valve and an exhaust valve that a camshaft opens or closes by torque transmitted thereto from a crankshaft, the valve timing controller comprising:

a first rotary body which rotates in synchronization with one of the crankshaft and the camshaft and into which lubricating fluid is supplied;

a second rotary body which rotates in synchronization with other of the crankshaft and the camshaft;

a torque producing unit for producing control torque; and a phase change unit including a planetary gear mechanism in which a planetary gear is engaged with a sun gear in such a way as to be able to perform a planetary motion and changing a relative rotational phase between the first rotary body and the second rotary body by utilizing the control torque transmitted from the torque producing unit to the planetary gear mechanism, wherein the phase change unit includes space forming means for forming a space at an interface where the first rotary body is brought into sliding contact with the planetary gear in the first rotary body wherein the space forming means is a protrusion formed on the planetary gear in such a way that its tip surface is brought into sliding contact with the first rotary body and forms the space on its outer peripheral side.

2. The valve timing controller according to claim 1, wherein the sun gear is provided coaxially with the first rotary body, and wherein the first rotary body is adjacent to the planetary gear in an axial direction of the first rotary body.

3. The valve timing controller according to claim 1, wherein the space has a size of 0.8 mm or more in a direction in which the first rotary body is adjacent to the planetary gear.

4. The valve timing controller according to claim 1, wherein the space forming means is a protrusion formed on the first rotary body in such a way that its tip surface is brought into sliding contact with the planetary gear and forms the space on its outer peripheral side.

5. The valve timing controller according to claim 4, wherein the space forming means is a plurality of protrusions formed at equal intervals around a rotational axis of the first rotary body.

6. The valve timing controller according to claim 1, wherein the space forming means is a hole that is open to a sliding contact surface of the planetary gear brought into sliding contact with the first rotary body and forms the space on its inner peripheral side.

7. The valve timing controller according to claim 6, wherein the space forming means is a plurality of holes formed at equal intervals around an axis of rotation of the planetary gear.

8. The valve timing controller according to claim 1, wherein the space forming means is a hole that is open to a sliding contact surface of the first rotary body brought into sliding contact with the planetary gear and forms the space on its inner peripheral side.

9. The valve timing controller according to claim 8, wherein the space forming means is a plurality of holes formed at equal intervals around a rotational axis of the first rotary body.

10. The valve timing controller according to claim 1, wherein the space forming means is a stepwise surface formed on the planetary gear and more depressed than a surface where the first rotary body is brought into sliding contact with the planetary gear and forms the space between the stepwise surface and the first rotary body.

11. The valve timing controller according to claim 10, wherein the space forming means is a stepwise surface formed in an annular shape extending around a rotational axis of the planetary gear.

12. The valve timing controller according to claim 1, wherein the space forming means is a stepwise surface formed on the first rotary body and more depressed than a sliding contact surface of the first rotary body brought into sliding contact with the planetary gear and forms the space between the stepwise surface and the planetary gear.

13. The valve timing controller according to claim 12, wherein the space forming means is a stepwise surface formed in an annular shape extending around a rotational axis of the first rotary body.

14. The valve timing controller according to claim 1, wherein the space forming means is a plurality of protrusions formed at equal intervals around an axis of rotation of the planetary gear.

15. The valve timing controller according to any one of claims 1, wherein the torque producing means is an electric motor.

16. A valve timing controller of an internal combustion engine for adjusting opening and closing timing of at least one of an intake valve and an exhaust valve that a camshaft opens or closes by torque transmitted thereto from a crankshaft, the valve timing controller comprising:

a first rotary body which rotates in synchronization with one of the crankshaft and the camshaft and into which lubricating fluid is supplied;

a second rotary body which rotates in synchronization with other of the crankshaft and the camshaft;

a torque producing unit for producing control torque; and a phase change unit including a planetary gear mechanism, in which a planetary gear is engaged with a sun gear in such a way as to be able to perform a planetary motion and in which a transmission rotary body is engaged with the planetary gear in such a way as to be able to rotate in sliding contact with the planetary gear, the phase changing unit changing a relative rotational phase between the first rotary body and the second rotary body by utilizing the control torque transmitted from the torque producing unit to the planetary gear and the transmission rotary body in succession, wherein the phase change unit includes space forming means for forming a space at an interface where the planetary gear is brought into sliding contact with the transmission rotary body in the first rotary body, the space forming means is a hole provided in planetary gear that is open to a sliding contact surface of the planetary gear brought into sliding contact with the transmission rotary body and forms the space on its inner peripheral side, and the hole is open in such a manner as to face a flat sliding contact surface of the transmission rotary body.

17. The valve timing controller according to claim 16, wherein the sun gear is provided coaxially with the transmission rotary body, and wherein the planetary gear is adjacent to the transmission rotary body in an axial direction of the transmission rotary body.

18. The valve timing controller according to claim 16, wherein the space has a size of 0.8 mm or more in a direction in which the planetary gear is adjacent to the transmission rotary body.

19. The valve timing controller according to claim 16, wherein the space forming means is a protrusion formed on the planetary gear in such a way that its tip surface is brought into sliding contact with the transmission rotary body and forms the space formed on its outer peripheral side.

20. The valve timing controller according to claim 16, wherein the space forming means is a protrusion formed on the transmission rotary body in such a way that its tip surface is brought into sliding contact with the planetary gear and forms the space on its outer peripheral side.

21. The valve timing controller according to claim 20, wherein the space forming means is a plurality of protrusions formed at equal intervals around a rotational axis of the transmission rotary body.

22. The valve timing controller according to claim 16, wherein the space forming means is a hole that is open to a sliding contact surface of the transmission rotary body brought into sliding contact with the planetary gear and forms the space on its inner peripheral side.

23. The valve timing controller according to claim 22, wherein the space forming means is a plurality of holes formed at equal intervals around a rotational axis of the transmission rotary body.

24. The valve timing controller according to claim 16, wherein the space forming means is a stepwise surface formed on the planetary gear and more depressed than a surface where the transmission rotary body is brought into sliding contact with the planetary gear and forms the space between the stepwise surface and the transmission rotary body.

25. The valve timing controller according to claim 16, wherein the space forming means is a stepwise surface formed on the transmission rotary body and more depressed than a sliding contact surface of the transmission rotary body brought into sliding contact with the planetary gear and forms the space between the stepwise surface and the first rotary body.

26. The valve timing controller according to claim 18, wherein the space forming means is a stepwise surface formed in an annular shape extending around a rotational axis of the transmission rotary body.

* * * * *